US009904197B2

(12) United States Patent
Eri et al.

(10) Patent No.: US 9,904,197 B2
(45) **Date of Patent: *Feb. 27, 2018**

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yoshifumi Eri, Kanagawa (JP); Hiroyoshi Okuno, Kanagawa (JP); Satoshi Inoue, Kanagawa (JP); Yoshifumi Iida, Kanagawa (JP); Tomohito Nakajima, Kanagawa (JP); Yuka Zenitani, Kanagawa (JP); Takeshi Iwanaga, Kanagawa (JP); Sakae Takeuchi, Kanagawa (JP); Shunsuke Nozaki, Tokyo (JP); Yasuo Kadokura, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/216,018

(22) Filed: Jul. 21, 2016

(65) Prior Publication Data

US 2017/0227874 A1 Aug. 10, 2017

(30) Foreign Application Priority Data

Feb. 10, 2016 (JP) ..... 2016-024139

(51) Int. Cl.

| | |
|---|---|
| ***G03G 9/097*** | (2006.01) |
| ***G03G 15/08*** | (2006.01) |
| ***G03G 9/08*** | (2006.01) |
| ***G03G 9/087*** | (2006.01) |

(52) U.S. Cl.

CPC ..... *G03G 9/09725* (2013.01); *G03G 9/0819* (2013.01); *G03G 9/0827* (2013.01); *G03G 9/08755* (2013.01); *G03G 15/08* (2013.01); *G03G 15/0865* (2013.01); *G03G 2215/0132* (2013.01)

(58) Field of Classification Search

CPC ..... G03G 9/09725; G03G 9/08711

See application file for complete search history.

(56) References Cited

U.S. PATENT DOCUMENTS

2001/0051270 A1 12/2001 Yamashita et al.

FOREIGN PATENT DOCUMENTS

| | | |
|---|---|---|
| JP | H10-186715 A | 7/1998 |
| JP | H11-133653 A | 5/1999 |
| JP | 2002-139862 A | 5/2002 |

(Continued)

OTHER PUBLICATIONS

U.S. Appl. No. 15/205,951, filed Jul. 8, 2016.*

(Continued)

*Primary Examiner* — Peter Vajda

(74) *Attorney, Agent, or Firm* — Oliff PLC

(57) ABSTRACT

An electrostatic charge image developing toner includes toner particles containing a binder resin, and an external additive including silica particles having a compression aggregation degree is from 60% to 95% and a particle compression ratio is from 0.20 to 0.40, and resin particles containing a polymer obtained by polymerizing a (meth) acrylic acid ester monomer.

12 Claims, 2 Drawing Sheets

(56) References Cited

FOREIGN PATENT DOCUMENTS

| | | | |
|---|---|---|---|
| JP | 2004-219609 | A | 8/2004 |
| JP | 2009-098700 | A | 5/2009 |
| JP | 2009-157161 | A | 7/2009 |
| JP | 4347201 | B2 | 10/2009 |
| JP | 2009-292915 | A | 12/2009 |
| JP | 4758655 | B2 | 8/2011 |
| JP | 4828032 | B2 | 11/2011 |
| JP | 2012-173412 | A | 9/2012 |
| JP | 2013-41065 | A | 2/2013 |
| JP | 2014-162678 | A | 9/2014 |
| JP | 2014-185069 | A | 10/2014 |
| JP | 2015-96884 | A | 5/2015 |
| JP | 2015-106123 | A | 6/2015 |

OTHER PUBLICATIONS

Jul. 25, 2017 Office Action issued in Japanese Patent Application No. 2016-024139.

Nov. 7, 2017 Decision of Refusal issued in Japanese Application No. 2016-024139.

* cited by examiner

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-024139 filed Feb. 10, 2016.

BACKGROUND

1. Technical Field

The present invention relates to an electrostatic charge image developing toner, an electrostatic charge image developer, and a toner cartridge.

2. Related Art

A silica particle is used as an additive component or a main component for cosmetics, rubber, a polishing agent or the like, and plays a role of, for example, improving toughness of a resin, improving fluidity of powder, or preventing a phenomenon (packing) in which the closest packing is approximated. The characteristics of the silica particle appears to be easily depend on a shape and surface properties of the silica particle, and deformation of the silica particle or surface treatment of the silica particle is proposed.

SUMMARY

According to an aspect of the invention, there is provided an electrostatic charge image developing toner including:

toner particles containing a binder resin; and an external additive including silica particles having a compression aggregation degree is from 60% to 95% and a particle compression ratio is from 0.20 to 0.40, and resin particles containing a polymer obtained by polymerizing a (meth)acrylic acid ester monomer.

BRIEF DESCRIPTION OF THE DRAWINGS

Exemplary embodiments of the present invention will be described in detail based on the following figures, wherein.

DETAILED DESCRIPTION

Figure 1:
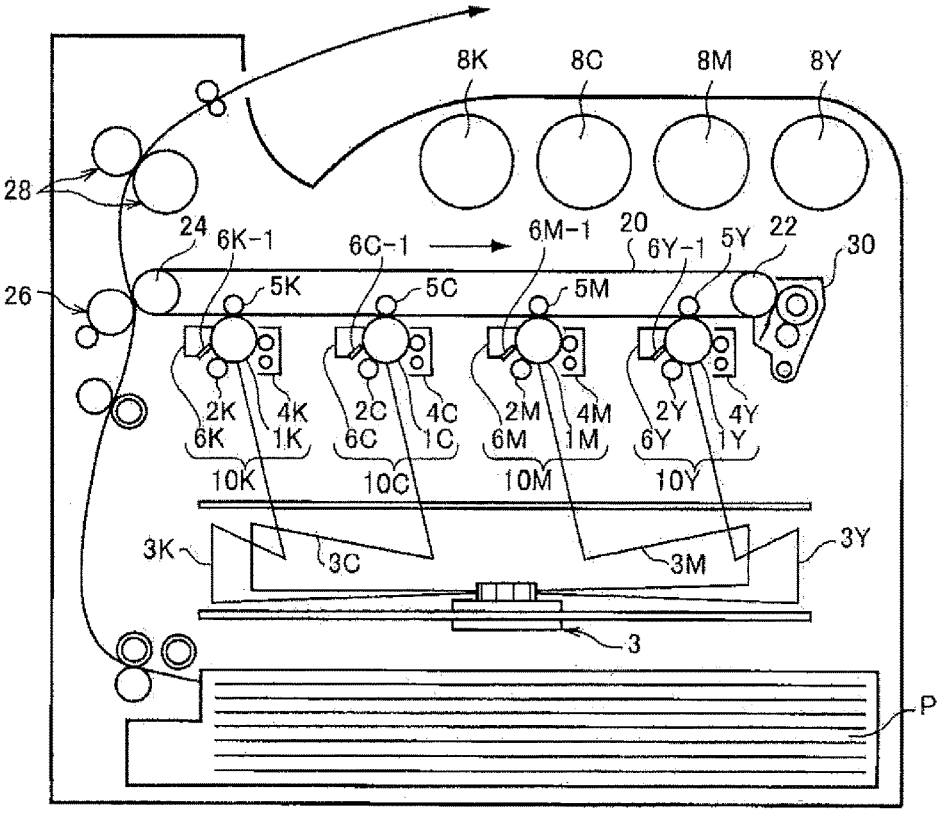
FIG. 1 is a schematic configuration view illustrating an example of an image forming apparatus according to the exemplary embodiment.

An exemplary embodiment which is an example of the present invention will be described in detail.

Electrostatic Charge Image Developing Toner

An electrostatic charge image developing toner (hereinafter, referred to as "toner") according to the exemplary embodiment is a toner which includes toner particles containing a binder resin, and an external additive.

The external additive includes a silica particle (hereinafter, referred to as "specific silica particles") in which a compression aggregation degree is from 60% to 95% and a particle compression ratio is from 0.20 to 0.40, and a resin particle (resin particle containing (meth)acrylic acid ester) containing a polymer obtained by polymerizing (meth) acrylic acid ester monomers.

The external additive (that is, the specific silica particle and the resin particle containing (meth)acrylic acid ester) in the exemplary embodiment may be included on the outside of the toner particle, and may adhere to a surface of the toner particle or may be released.

A silica particle which is externally added to the toner particle as an external additive for ensuring fluidity of the toner, is known. When the silica particle reaches a cleaning portion, the particles are blocked at the tip end (a part on the downstream side in the rotational direction of a contact portion of a cleaning blade and a photosensitive member) of the cleaning portion, and an aggregate (hereinafter, referred to as "externally added barrier") which is aggregated by pressure from the cleaning blade, is formed. The externally added barrier contributes to improving cleaning properties.

Meanwhile, when an image is repeatedly output, wear of the cleaning blade is accelerated by a frictional force between the photosensitive member and the cleaning blade, an image defect, such as a color streak, is likely to be formed due to a cleaning defect caused by wear of the cleaning blade. In addition, with the purpose of reducing friction between the photosensitive member and the cleaning blade, external addition of the resin particle containing (meth) acrylic acid ester to the toner particle is known together with the silica particle as an external additive.

However, the resin particle containing (meth)acrylic acid ester has properties of being likely to pass from the cleaning portion. By the passing of the resin particle from the cleaning portion, friction between the photosensitive member and the cleaning blade is reduced, but in a case of excessive passing, toner scatter is likely to be formed in the charging member by the passed resin particle. The toner scatter of the charging member becomes a factor which causes an image defect (for example, formation of a color streak).

Meanwhile, in the toner according to the exemplary embodiment, both the specific silica particle and the resin particle containing (meth)acrylic acid ester are used as the external additive which is externally added to the toner particle. Accordingly, excessive passing of the resin particle containing (meth)acrylic acid ester from the cleaning portion is prevented, and the toner scatter of the charging member caused by the passing is prevented.

The reason thereof is unknown, but the following reasons are considered.

The specific silica particle in which the compression aggregation degree and the particle compression ratio satisfy the above range, is a silica particle which has properties that fluidity is high and aggregation properties are also high.

Here, the silica particle generally has excellent fluidity, but bulk density is low while fluidity is excellent, and thus, the silica particle has properties that the aggregation is difficult.

Meanwhile, with the purpose of improving fluidity of the silica particle, a technology which performs surface treatment with respect to the surface of the silica particle by using a hydrophobizing agent, is known. According to the technology, fluidity of the silica particle is improved, but the aggregation properties remain to be low.

In addition, a technology which performs the surface treatment with respect to the surface of the silica particle by using both the hydrophobizing agent and the silicone oil, is also known. According to the technology, the aggregation properties are improved. However, on the contrary, fluidity is likely to deteriorate.

In other words, in the silica particles, fluidity and the aggregation properties have a contrary relationship.

Meanwhile, in the specific silica particle, as described above, by setting the compression aggregation degree and the particle compression ratio to be in the above range, the two contrary properties, such as fluidity and aggregation properties, become excellent.

Next, the meaning that the compression aggregation degree and the particle compression ratio of the specific silica particle are in the above range, will be described in order.

First, the meaning of setting the compression aggregation degree of the specific silica particle to be from 60% to 95% will be described.

The compression aggregation degree is an index indicating the aggregation properties of the silica particle. The index indicates a degree of being loosened of a molded article when dropping the molded article of the silica particle, after obtaining the molded article of the silica particle by compressing the silica particle.

Accordingly, as the compression aggregation degree increases, in the silica particle, the bulk density is likely to increase, and a cohesive force (intermolecular force) tends to be strengthened. In addition, a calculation method of the compression aggregation degree will be described later in detail.

Therefore, the aggregation properties of the specific silica particle in which the compression aggregation degree is controlled to be high, that is, from 60% to 95%, become excellent. However, while maintaining the aggregation properties to be excellent, from the viewpoint of ensuring the fluidity, the upper limit value of the compression aggregation degree becomes 95%.

Next, the meaning of setting the particle compression ratio of the specific silica particle to be from 0.20 to 0.40 will be described.

The particle compression ratio is an index indicating fluidity of the silica particle. Specifically, the particle compression ratio is indicated by a ratio of a difference between a packed apparent specific gravity and a loosened apparent specific gravity of the silica particle, and the packed apparent specific gravity ((packed apparent specific gravity−loosened apparent specific gravity)/packed specific gravity).

Accordingly, fluidity of the silica particle increases as the particle compression ratio decreases. In addition, a calculation method of the particle compression ratio will be described later in detail.

Therefore, the specific silica particle in which the particle compression ratio is controlled to be low, that is, from 0.20 to 0.40, has excellent fluidity. However, while maintaining excellent fluidity, the lower limit value of the particle compression ratio is set to be 0.20 from the viewpoint of improving the aggregation properties.

Above, the specific silica particle has unique properties that the particle is likely to flow, and further, the cohesive force is great. Therefore, the specific silica in which the compression aggregation degree and the particle compression ratio satisfy the above range, is a silica particle having properties that fluidity and aggregation properties are high.

Next, an estimation action when both the specific silica particle and the resin particle containing (meth)acrylic acid ester are used as the external additive which is externally added to the toner particle, will be described.

First, since fluidity is high, when the specific silica particle reaches the cleaning portion, it becomes easy to move across the entire axial direction of the photosensitive member before the specific silica particle reaches the tip end of the cleaning portion. Accordingly, the specific silica particle is likely to reach in an approximately uniform state across the entire tip end of the cleaning portion. In other words, the externally added barrier is likely to be formed in an approximately uniform state across the entire tip end of the cleaning portion.

Meanwhile, since aggregation properties of the specific silica particle are also high, the externally added barrier formed across the tip end of the cleaning portion is likely to be strongly formed.

In other words, by using the specific silica particle as the external additive, according to "fluidity" of the specific silica particle, the externally added barrier is likely to be formed in an approximately uniform state across the entire tip end of the cleaning portion, and further, according to "aggregation properties" of the specific silica particle, the externally added barrier is likely to be strongly formed.

Accordingly, cleaning properties at the cleaning portion is improved, and excessive passing of the resin particle containing (meth)acrylic acid ester from the cleaning portion is prevented.

Above, according to the toner according to the exemplary embodiment, the toner scatter of the charging member caused by the passing of the resin particle containing (meth) acrylic acid ester from the cleaning portion is prevented. In addition, the image defect (for example, formation of a color streak) caused by the toner scatter of the charging member is prevented.

However, as described above, since the specific silica particle has high fluidity, dispersibility to the toner particle when being externally added to the toner particle, also increases. Furthermore, in the specific silica particle, since the aggregation properties are high, adhesiveness to the toner particle also increases. In other words, when the specific silica particle is externally added to the toner particle, by the properties that fluidity and dispersibility to the toner particle are high, the specific silica particle is likely to adhere to the surface of the toner particle in an approximately uniform state. In addition, by the properties that the aggregation properties and the adhesiveness to the toner particle are high, the specific silica particle adhering to the toner particle is unlikely to move on the toner particle and be released from the toner particle, by a mechanical load caused by agitating or the like in a developing unit. In other words, a change in the external addition structure is unlikely to occur. Accordingly, the fluidity of the toner particle itself increases, and high fluidity is likely to be maintained. As a result, charging properties are likely to be maintained.

Above, in the toner according to the exemplary embodiment, charging maintaining properties become excellent by containing the specific silica particle as the external additive.

In the toner according to the exemplary embodiment, it is preferable that the specific silica particle has a particle dispersion degree which is from 90% to 100%.

Here, the meaning of setting the particle dispersion degree of the specific silica particle to be from 90% to 100% will be described.

The particle dispersion degree is an index indicating the dispersibility of the silica particle. The index is indicated by a degree of being likely to disperse the silica particle to the toner particle in a primary particle state. Specifically, when a calculated coverage of the surface of the toner particle with the silica particle is $C_0$, and an actually measured coverage is C, the particle dispersion degree is indicated by a ratio of the actually measured coverage C to the attachment target, to the calculated coverage $C_0$ (actually measured coverage C/calculated coverage $C_0$).

Accordingly, as the particle dispersion degree increases, the silica particle is unlikely to aggregate, and is likely to disperse to the toner particle in the primary particle state. In addition, a calculation method of the particle dispersion degree will be described later in detail.

The specific silica particle has more excellent dispersibility to the toner particle by controlling the particle dispersion degree to be high, that is, from 90% to 100%, while controlling the compression aggregation degree and the particle compression ratio to be in the above range. Accordingly, fluidity of the toner particle itself further increases, and the high fluidity is likely to be maintained. As a result, further, the specific silica particle is likely to adhere to the surface of the toner particle in an approximately uniform state, and the charging maintaining properties becomes excellent.

In the toner according to the exemplary embodiment, as described above, as the specific silica particle having the properties that the fluidity and the aggregation properties are high, a silica particle which has relatively large weight average molecular weight and in which the siloxane compound adheres to the surface, is appropriately employed.

Specifically, a silica particle in which the siloxane compound in which viscosity is 1,000 cSt to 50,000 cSt adheres to the surface (preferably, adhesion in which the surface attachment amount is from 0.01% by weight to 5% by weight), is appropriately employed. In the specific silica particle, for example, a method of surface-treating the surface of the silica particle by using the siloxane compound in which viscosity is from 1,000 cSt to 50,000 cSt, so that the surface attachment amount becomes from 0.01% by weight to 5% by weight, may be employed.

Here, the surface attachment amount is a ratio with respect to the silica particle (untreated silica particle) before surface-treating the surface of the silica particle. Hereinafter, the silica particle before the surface treatment (that is, the silica particle which has not been treated) will be simply referred to as "silica particle".

The specific silica particle in which the surface of the silica particle is treated by using the siloxane compound in which viscosity is from 1,000 cSt to 50,000 cSt so that the surface attachment amount becomes from 0.01% by weight to 5% by weight has high fluidity and aggregation properties, and the compression aggregation degree and the particle compression ratio are likely to satisfy the above-described requirements. The reason thereof is unknown, but the following reasons may be considered.

When a small amount of siloxane compound having relatively high viscosity in which viscosity is in the above range adheres to the surface of the silica particle within the above range, a function which originates from the characteristic of the siloxane compound of the surface of the silica particle is achieved. The mechanism thereof is not apparent. However, when the silica particle flows, releasability which originates from the siloxane compound is likely to be achieved as a small amount of siloxane compound having relatively high viscosity adheres to the surface of the silica particle within the above range, or adhesiveness between the silica particles decreases as the intermolecular force decreases by steric hindrance of the siloxane compound. Accordingly, fluidity of the silica particle further increases.

Meanwhile, when the silica particle is pressurized, a long molecular chain of the siloxane compound on the surface of the silica particle becomes entangled, closest packing properties of the silica particle increase, and aggregation between the silica particles is toughened. In addition, it is considered that the cohesive force of the silica particle by the entanglement of the long molecular chain of the siloxane compound is released when the silica particle flows. Additionally, the adhesion force to the toner particle also increases by the long molecular chain of the siloxane compound on the surface of the silica particle.

Above, in the specific silica particle in which a small amount of siloxane compound in which viscosity is within the above range adheres to the surface of the silica particle within the above range, the compression aggregation degree and the particle compression ratio are likely to satisfy the above-described requirements, and the particle dispersion degree is also likely to satisfy the above-described requirements.

Hereinafter, a configuration of the toner will be described in detail.

Toner Particle

The toner particle includes, for example, a binder resin. The toner particle may include a coloring agent, a release agent, and other additives, as necessary.

Binder Resin

Examples of the binder resin include a vinyl resin such as a homopolymer of a monomer, such as styrenes (for example, styrene, parachlorostyrene, and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles type (for example, acrylonitrile and methacrylonitrile), vinyl ethers (for example, vinylmethylether and vinyl isobutyl ether), vinyl ketones (for example, vinyl methyl ketone, vinyl ethyl ketone, and vinyl isopropenyl ketone), olefins (for example, ethylene, propylene, and butadiene), or a copolymer obtained by combining two or more of these monomers.

Examples of the binder resin include non-vinyl resins (for example, an epoxy resin, a polyester resin, a polyurethane resin, a polyimide resin, a cellulose resin, a polyether resin, and a modified rosin), a mixture of these and the above-described vinyl resin, and a graft polymer which is obtained by polymerizing the vinyl monomer in the coexistence of these resins.

These binder resins may be used alone or in combination of two or more kinds thereof.

As the binder resin, the polyester resin is appropriate.

Example of the polyester resin includes a known polyester resin.

Examples of the polyester resin includes a condensation polymer of a polyvalent carboxylic acid and a polyol. In addition, as the polyester resin, a commercially available product may be used, and a synthesized resin may be used.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexanedicarboxylic acid), aromatic dicarboxylic acid (for example, terephthalic acid, isophthalic acid, phthalic acid, and naphthalenedicarboxylic acid), anhydrides thereof, or lower (for example, from 1 to 5 carbon atoms) alkyl esters thereof. Among these, for example, aromatic dicarboxylic acid is preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower (for example, from 1 to 5 carbon atoms) alkyl esters thereof.

The polyvalent carboxylic acids may be used alone or in combination of two or more kinds thereof.

Examples of the polyol include aliphatic diol (for example, ethylene glycol, diethylene glycol, triethylene glycol, propylene glycol, butanediol, hexanediol, or neopentyl glycol), alicyclic diol (for example, cyclohexanediol, cyclohexanedimethanol, or hydrogenated bisphenol A), or aromatic dial (for example, ethylene oxide adduct of bisphenol A, or propylene oxide adduct of bisphenol A). Among these, as the polyol, for example, the aromatic diol and the alicyclic diol are preferable, and the aromatic dial is more preferable.

As the polyol, tri- or higher-hydric alcohol employing a crosslinked structure or a branched structure may be used in combination with diol. Examples of the tri- or higher-hydric alcohol include glycerin, trimethylolpropane, or pentaerythritol.

The polyol may be used alone or in combination of two or more kinds thereof.

A glass transition temperature (Tg) of the polyester resin is preferably from 50° C. to 80° C., and more preferably from 50° C. to 65° C.

The glass transition temperature is determined by a DSC curve which is obtained by differential scanning calorimetry (DSC). More specifically, the glass transition temperature is determined by an "extrapolated starting temperature of glass transition" described in a determining method of the glass transition temperature of a JIS K7121-1987 "Testing methods for transition temperature of plastic".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight are measured by gel permeation chromatography (GPC). The measurement of the molecular weight by the GPC is performed by using an GPC•HLC-8120 GPC manufactured by Tosoh Corporation as a measurement apparatus, a Column TSKgel SuperHM-M (15 cm) manufactured by Tosoh Corporation, and a THF solvent. The weight average molecular weight and the number average molecular weight are calculated by using a molecular weight calibration curve which is drawn up by a monodisperse polystyrene standard sample from the measurement result.

The polyester resin may be obtained by a known preparing method. Specifically, for example, the polyester resin may be obtained by a reaction method of setting a polymerization temperature to be from 180° C. to 230° C., reducing pressure in a reaction system as necessary, and removing water or alcohol formed during condensation.

In a case where a monomer of a raw material is not dissolved or is not compatible at a reaction temperature, a solvent having a high boiling point may be added as a solubilizing agent and dissolution may be performed. In this case, the polycondensation reaction is performed while distilling the solubilizing agent. In a case where a monomer having a low compatibility exists, the monomer having a low compatibility and an acid or alcohol which is planned to be polycondensed with the monomer are condensed in advance, and then, the resultant may be polycondensed together with a main component. A content of the binder resin, for example, with respect to the entirety of the toner particles, is preferably from 40% by weight to 95% by weight, more preferably from 50% by weight to 90% by weight, and still more preferably from 60% by weight to 85% by weight.

Coloring Agent

Examples of the coloring agent include various types of pigments, such as carbon black, chrome yellow, Hansa yellow, benzidine yellow, threne yellow, quinoline yellow, pigment yellow, permanent orange GTR, pyrazolone orange, vulcan orange, Watchung red, permanent red, brilliant carmine 3B, brilliant carmine 6B, Dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, or malachite green oxalate; and various dyes, such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, or thiazole dye.

The coloring agent may be used alone or in combination of two or more kinds thereof.

As the coloring agent, a surface-treated coloring agent may be used as necessary, and the coloring agent and a dispersing agent may be used together. In addition, plural coloring agents may be used together.

The content of the coloring agent is, for example, preferably from 1% by weight to 30% by weight, and more preferably from 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

A melting temperature of the release agent is preferably from 50° C. to 110° C., and more preferably from 60° C. to 100° C.

The melting temperature is determined from a DSC curve which is obtained by differential scanning calorimetry (DSC), by a "melting peak temperature" described in a determining method of the melting temperature of a JIS K7121-1987 "Testing methods for transition temperature of plastic".

The content of the release agent is, for example, preferably from 1% by weight to 20% by weight and more preferably from 5% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single layer structure, or may be toner particles having a so-called core•shell structure which is configured of a core (core particles) and a coating layer (shell layer) which coats the core.

Here, for example, the toner particles having the core shell structure may be configured of a core which includes a binder resin and other additives, such as a coloring agent and a release agent as necessary, and a coating layer which includes the binder resin.

The volume average particle diameter (D50v) of the toner particles is preferably from 2 μm to 10 μm, and more preferably from 4 μm to 8 μm.

Various average particle diameters and various particle diameter distribution indexes of the toner particles are measured by using a COULTER MULTISIZER-II (manufactured by Beckman coulter, Inc.), and by using an ISOTON-II (manufactured by Beckman coulter, Inc.) as an electrolyte.

During the measurement, as the dispersing agent, 0.5 mg to 50 mg of the measurement sample is added to 2 ml of 5% aqueous solution of surfactant (sodium alkylbenzene sulfonate is preferable). The resultant is added to 100 ml to 150 ml of the electrolyte.

Dispersion processing is performed for 1 minute by an ultrasonic homogenizer with respect to the electrolyte which suspends the sample. By the COULTER MULTISIZER-II, the particle diameter distribution of the particle having a particle diameter of 2 μm to 60 μm is measured by using an aperture having an aperture diameter of 100 μm. The number of sampling particles is 50,000.

By drawing cumulative distribution of each of the volume and the number from a small diameter side with respect to a particle diameter range (channel) divided based on the measured particle diameter distribution, a particle diameter which has cumulation of 16% is defined as a volume particle diameter D16v and a number particle diameter D16p, a particle diameter which has cumulation of 50% is defined as a volume average particle diameter D50v and a cumulation number average particle diameter D50p, and a particle diameter which has cumulation of 84% is defined as a volume particle diameter D84v and a number particle diameter D84p.

By using these, a volume average particle diameter distribution index (GSDv) is calculated by $(D84v/D16v)^{1/2}$, and a number average particle diameter distribution index (GSDp) is calculated by $(D84p/D16p)^{1/2}$.

The average circularity of the toner particles is preferably from 0.94 to 1.00, and more preferably from 0.94 to 0.98.

The average circularity of the toner particles is determined by (equivalent circle periphery length)/(periphery length) ((periphery length of circle having the same projected area as that of particle image)/(periphery length of particle projected image)). Specifically, the average circularity of the toner particles is a value measured by the following method.

First, the toner particle in which the external additive is removed by performing ultrasonic treatment after dispersing the toner (developer) which becomes the measurement target in the water including the surfactant, is obtained. The particle image is taken as a still image by suctioning and collecting the obtained toner particle, by forming a flat flow, and by emitting strobe light instantly, and the average circularity is determined by a flow type particle image analyzing apparatus (FPIA-2100 manufactured by Sysmex Corporation) which analyzes the particle image. In addition, the number of samples when determining the average circularity is 3500.

External Additive

The external additive includes the specific silica particle and the resin particle (resin particle containing (meth)acrylic acid ester) containing a polymer obtained by polymerizing the (meth)acrylic acid ester monomers. The external additive may include other external additives other than the specific silica particle and the resin particle containing (meth)acrylic acid ester. In other words, the specific silica particle, the resin particle containing (meth)acrylic acid ester, and other external additives may be externally added to the toner particle.

Specific Silica Particle

Compression Aggregation Degree

The compression aggregation degree of the specific silica particle is from 60% to 95%, but in the specific silica particle, and from the viewpoint of ensuring aggregation properties and fluidity in the specific silica particle, that is, from the viewpoint of preventing the toner scatter of the charging member caused by the passing of the resin particle containing (meth)acrylic acid ester from the cleaning portion, the compression aggregation degree is preferably from 70% to 95%, and more preferably from 80% to 95%.

The compression aggregation degree is calculated by the following method.

A disk-shaped mold having a diameter of 6 cm is filled with 6.0 g of specific silica particles. Next, the mold is compressed for 60 seconds by pressure of 5.0 t/cm$^2$ by using a compression molding machine (manufactured by Maekawa Testing Machine MFG. Co., Ltd.), and a molded article (hereinafter, referred to as "molded article before dropping") of the compressed disk-shaped specific silica particle is obtained. After this, the weight of the molded article before dropping is measured.

Next, the molded article before dropping is disposed on a sieving net in which an aperture is 600 μm, and the molded article before dropping is dropped under a condition that an amplitude is 1 mm and oscillation time is 1 minute by an oscillation sieving machine (manufactured by Tsutsui Scientific Instruments Co., Ltd.: product number VIBRATING MVB-1). Accordingly, the specific silica particle is dropped via the sieving net from the molded article before dropping, and the molded article of the specific silica particle remains on the sieving net. After this, the weight of the molded article of the remaining specific silica particle (hereinafter, referred to as "molded article after dropping") is measured.

In addition, by using the following Expression (1), the compression aggregation degree is calculated from a ratio of the weight of the molded article after dropping and the weight of the molded article before dropping.

compression aggregation degree=(weight of the molded article after dropping/weight of the molded article before dropping)×100 Expression (1):

Particle Compression Ratio

The particle compression ratio of the specific silica particle is from 0.20 to 0.40, and from the viewpoint of ensuring aggregation properties and fluidity in the specific silica particle, that is, from the viewpoint of preventing the toner scatter of the charging member caused by the passing of the resin particle containing (meth)acrylic acid ester from the cleaning portion, the particle compression ratio is preferably from 0.24 to 0.38, and more preferably from 0.28 to 0.36.

The particle compression ratio is calculated by the following method.

The loosened apparent specific gravity and the packed apparent specific gravity of the specific silica particle are measured by using a powder tester (product number PT-S manufactured by Hosokawa Micron Corporation). In addition, by using the following Expression (2), particle compression ratio is calculated from the ratio of the difference between the packed apparent specific gravity and the loosened apparent specific gravity of the specific silica particle, and the packed apparent specific gravity.

particle compression ratio=(packed apparent specific gravity−loosened apparent specific gravity)/packed apparent specific gravity Expression (2):

In addition, the "loosened apparent specific gravity" is a measured value which is derived by filling a container having a volume of 100 $cm^3$ with the specific silica particle and weighing the container, and is referred to as filling specific gravity in a state where the specific silica particle is naturally dropped in the container. The "packed apparent specific gravity" is referred to as an apparent specific gravity when an impact is repeatedly imparted (tapping) to a bottom portion of the container 180 times at the stroke length of 18 mm and the tapping speed of 50 times per minute from the state of the loosened apparent specific gravity, the deairation is performed, the specific silica particles are rearranged, and the container is more tightly filled.

Particle Dispersion Degree

The particle dispersion degree of the specific silica particle is preferably from 90% to 100%, more preferably from 95% to 100%, and still more preferably 100%, from the viewpoint of more excellent dispersibility to the toner particle (that is, from the viewpoint of excellent charging maintaining properties).

The particle dispersion degree is a ratio of the actually measured coverage C to the toner particle and the calculated coverage $C_0$, and is calculated by using the following Expression (3).

particle dispersion degree=actually measured coverage $C$/calculated coverage $C_0$ Expression (3):

Here, the calculated coverage $C_0$ of the surface of the toner particle with the specific silica particle may be calculated by the following Expression (3-1) when the volume average particle diameter of the toner particles is dt(m), an average equivalent circle diameter of the specific silica particles is da(m), a specific gravity of the toner particle is pt, a specific gravity of the specific silica particle is pa, the weight of the toner particle is Wt(kg), and the amount added of the specific silica particle is Wa(kg).

calculated coverage $C_0=\sqrt{3}/(2\pi)\times(\rho t/\rho a)\times(dt/da)\times(Wa/Wt)\times 100(\%)$ Expression (3-1):

The actually measured coverage C of the surface of the toner particle with the specific silica particle may be calculated by measuring a signal strength of a silicon atom which originates from the specific silica particle, respectively, with respect only to the toner particle, only to the specific silica particle, and to the toner particle coated (adhered) with the specific silica particle, by an X-ray photoelectron spectroscopy (XPS) ("JPS-9000MX": manufactured by JEOL Ltd.) and by using the following Expression (3-2).

actually measured coverage $C=(z-x)/(y-x)\times 100(\%)$ Expression (3-2):

(In the Expression (3-2), x represents the signal strength of the silicon atom which originates from the specific silica particle only of the toner particle, y represents the signal strength of the silicon atom which originates from the specific silica particle only of the specific silica particle z represents the signal strength of the silicon atom which originates from the specific silica particle with respect to the toner particle coated (adhered) with the specific silica particle.)

Average Equivalent Circle Diameter

The average equivalent circle diameter of the specific silica particles is preferably from 40 nm to 200 nm, more preferably from 50 nm to 180 nm, and still more preferably from 60 nm to 160 nm, from the viewpoint of ensuring aggregation properties and fluidity in the specific silica particle, that is, from the viewpoint of preventing the toner scatter of the charging member caused by the passing of the resin particle containing (meth)acrylic acid ester from the cleaning portion.

An image is captured observing a primary particle after externally adding the specific silica particle to the toner particle by a scanning electron microscope (SEM) device (manufactured by Hitachi, Ltd.: S-4100), the image is input to an image analyzing device (WinROOF manufactured by Mitani Corporation), an area for each particle is measured by analyzing the image of the primary particle, and an equivalent circle diameter is calculated from the area value. The diameter of 50% (D50) in a cumulative frequency of the obtained equivalent circle diameter of a volume standard is the average equivalent circle diameter D50 of the specific silica particles. In addition, the electron microscope adjusts magnification so as to capture approximately 10 to 50 specific silica particles in one visual field, and the equivalent circle diameter of the primary particle is obtained by combining the observation results of the plural visual fields.

Average Circularity

A shape of the specific silica particle may be any of a spherical shape or an irregular shape. However, the average circularity of the specific silica particles is preferably from 0.85 to 0.98, more preferably from 0.90 to 0.98, and still more preferably from 0.93 to 0.98, from the viewpoint of ensuring aggregation properties and fluidity in the specific silica particle.

The average circularity of the specific silica particles is measured by the following method.

First, circularity of the specific silica particle is obtained from analysis of the obtained plane image of the primary particle by observing the primary particle after externally adding the specific silica particles to the toner particle using the SEM device, by the following expression.

circularity$=4\pi\times(A/I^2)$ Expression:

(In the expression, I represents the periphery length of the primary particle on the image, and A represents a projected area of the primary particle.

In addition, the average circularity of the specific silica particles is obtained as 50% of the circularity in the cumulative frequency of circularity of 100 primary particles obtained by the above-described plane image analysis.

Here, a method of measuring each of the characteristics (compression aggregation degree, particle compression ratio, particle dispersion degree, average circularity) of the specific silica particles, will be described in detail.

First, the external additive is separated from the toner as follows. The toner is put into and dispersed in methanol, and after agitation, by performing treatment by an ultrasonic bus, it is possible to separate the specific silica particle or the resin particle containing (meth)acrylic acid ester, which is an external additive, from the toner. The ease of the separation is determined by a particle diameter and specific gravity of the external additive. For example, in a case of the resin particle containing (meth)acrylic acid ester having a particle diameter which is greater than that of the specific silica particle, the resin particle containing (meth)acrylic acid ester is likely to be peeled from the toner (toner particle). Therefore, the resin particle containing (meth)acrylic acid ester is peeled from the surface of the toner by weak centrifugal separation in which the ultrasonic treatment condition (for example, output and time) is set to be weak, and the toner is not deposited, and after this, only the amount of the resin particle containing (meth)acrylic acid ester deposited is collected by the weak centrifugal separation in which the toner is not deposited by the centrifugal separation. Next, the resin particle containing (meth)acrylic acid ester is taken out by volatilizing the methanol from the collected methanol solution.

Next, by changing the ultrasonic treatment condition (for example, output and time) to a strong condition, the specific silica particle is peeled from the surface of the toner, and after this, only the amount of the specific silica particle deposited is collected by the weak centrifugal separation in which the toner is not deposited by the centrifugal separation. Next, the specific silica particle is taken out by volatilizing the methanol from the collected methanol solution. The ultrasonic treatment condition is necessary to be adjusted by the specific silica particle and the resin particle containing (meth)acrylic acid ester. In addition, other methods may be performed as long as the separation is possible.

In addition, each of the characteristics is measured by using the separated specific silica particle and the resin particle containing (meth)acrylic acid ester.

Hereinafter, a configuration of the specific silica particle will be described in detail.

The specific silica particle is a particle having silica (that is, $SiO_2$) as a main component, and may be crystalline or noncrystalline. The specific silica particle may be a particle which is prepared by using the silicon compound, such as water glass or alkoxysilane, as a raw material, or may be a particle obtained by pulverizing quartz.

Specific examples of the specific silica particle include a silica particle (hereinafter, referred to as "sol-gel silica particle") which is prepared by a sol-gel method, an aqueous colloidal silica particle, an alcoholic silica particle, a fumed silica particle obtained by a vapor phase method, and a molten silica particle. Among these, the sol-gel silica particle is preferable.

Surface Treatment

In the specific silica particle, in order to set the compression aggregation degree and the particle compression ratio to be within the above specific range, it is preferable to perform the surface treatment with the siloxane compound.

As a surface treatment method, surface treatment with respect to the surface of the silica particle in supercritical carbon dioxide, by using supercritical carbon dioxide, is preferable. In addition, the surface treatment method will be described later.

Siloxane Compound

The siloxane compound is not particularly limited as long as the siloxane compound has a siloxane skeleton in a molecular structure.

Examples of the siloxane compound include silicone oil and silicone resin. Among these, silicone oil is preferable from the viewpoint of surface treatment with respect to the surface of the silica particle in an approximately uniform state.

Examples of silicone oil includes dimethylsilicone oil, methyl hydrogen silicone oil, methylphenyl silicone oil, amino-modified silicone oil, epoxy-modified silicone oil, carboxyl-modified silicone oil, carbinol-modified silicone oil, methacryl-modified silicone oil, mercapto-modified silicone oil, phenol-modified silicone oil, polyether-modified silicone oil, methylstyryl-modified silicone oil, alkyl-modified silicone oil, higher fatty acid ester-modified silicone oil, higher fatty acid amide-modified silicone oil, and fluorine-modified silicone oil. Among these, dimethylsilicone oil, methyl hydrogen silicone oil, and amino-modified silicone oil are preferable.

The siloxane compound may be used alone or in combination of two or more kinds thereof.

Viscosity

The viscosity (kinematic viscosity) of the siloxane compound is preferably from 1,000 cSt to 50,000 cSt, more preferably from 2,000 cSt to 30,000 cSt, and still more preferably from 3,000 cSt to 10,000 cSt, from the viewpoint of excellent fluidity and aggregation properties in the specific silica particle.

The viscosity of the siloxane compound is determined in the following order. Toluene is added to the specific silica particle, and dispersed for 30 minutes by an ultrasonic homogenizer. After this, supernatant is collected. At this time, a toluene solution of the siloxane compound having a concentration of 1 g/100 ml is prepared. A specific viscosity ($\eta_{sp}$) (25° C.) at this time is determined by the following Expression (A).

$$\eta_{sp}=(\eta/\eta_0)-1 \qquad \text{Expression (A):}$$

($\eta_0$: viscosity of toluene, $\eta$: viscosity of solution)

Next, intrinsic viscosity ($\eta$) is determined by substituting the specific viscosity ($\eta_{sp}$) into a relational expression of Huggins represented by the following Expression (B).

$$\eta_{sp}=(\eta)+K'(\eta)^2 \qquad \text{Expression (B):}$$

(K': constant of Huggins, K'=0.3 (($\eta$)=when adapting 1 to 3))

Next, a molecular weight M is determined by substituting the intrinsic viscosity ($\eta$) into an expression of A. Kolorlov represented by the following Expression (C).

$$(\eta)=0.215\times10^{-4}M^{0.65} \qquad \text{Expression (C):}$$

Viscosity ($\eta$) of siloxane is determined by substituting the molecular weight M into an expression of A. J. Barry represented by the following Expression (D).

$$\log \eta=1.00+0.0123M^{-0.5} \qquad \text{Expression (D):}$$

Surface Adhesion Amount

The surface attachment amount of the siloxane compound to the surface of the specific silica particle is preferably from 0.01% by weight to 5% by weight, more preferably from 0.05% by weight to 3% by weight, and still more preferably from 0.10% by weight to 2% by weight, with respect to the silica particle (silica particle before the surface treatment), from the viewpoint of excellent fluidity and aggregation properties in the specific silica particle.

The surface attachment amount is measured by the following method.

100 mg of the specific silica particles are dispersed in 1 mL of chloroform, 1 μL of DMF (N,N-dimethylformamide) is added as internal standard liquid, and then, ultrasonic treatment is performed for 30 minutes by an ultrasonic cleaner, and extraction of the siloxane compound in a chloroform solvent is performed. After this, hydrogen nucleus spectrum measurement is performed by a JNM-AL400 type nuclear magnetic resonance device (manufactured by JEOL Ltd.), and the amount of the siloxane compound is obtained from a ratio of a peak area which originates from the siloxane compound with respect to a peak area which originates from DMF. In addition, the surface attachment amount is obtained from the amount of the siloxane compound.

Here, in the specific silica particle, it is preferable that the surface treatment is performed with the siloxane compound in which viscosity is from 1,000 cSt to 50,000 cSt, and the surface attachment amount of the siloxane compound to the surface of the silica particle is from 0.01% by weight to 5% by weight.

By satisfying the above-described requirements, the specific silica particle which has improved fluidity and aggregation properties may be obtained.

External Addition Amount

The external addition amount (content) of the specific silica particle is preferably from 0.1% by weight to 5% by weight, more preferably from 0.2% by weight to 4% by weight, and still more preferably from 0.5% by weight to 3% by weight with respect to the toner particle, from the viewpoint of ensuring aggregation properties and fluidity in the specific silica particle, that is, from the viewpoint of preventing the toner scatter of the charging member caused by the passing of the resin particle containing (meth)acrylic acid ester from the cleaning portion.

Method of Preparing Specific Silica Particle

The specific silica particle may be obtained by treating the surface of the silica particle with the siloxane compound in which viscosity is from 1,000 cSt to 50,000 cSt so that the surface attachment amount is from 0.01% by weight to 5% by weight with respect to the silica particle.

According to the preparing method of the specific silica particle, the silica particle which has improved fluidity and aggregation properties may be obtained.

Examples of the surface treatment method include a method of treating the surface of the silica particle with the siloxane compound in supercritical carbon dioxide, and a method of treating the surface of the silica particle with the siloxane compound in the air.

Specific examples of the surface treatment method include a method of dissolving the siloxane compound in supercritical carbon dioxide, by using supercritical carbon dioxide, and adhering the siloxane compound to the surface of the silica particle; a method of providing (for example, spraying or coating) a solution containing the siloxane compound and a solvent which dissolves the siloxane compound to the surface of the silica particle, in the air, and adhering the siloxane compound to the surface of the silica particle; and a method of drying mixed solution of a silica particle dispersion and the solution after adding and maintaining the solution containing the siloxane compound and the solvent which dissolves the siloxane compound in the silica particle dispersion, in the air.

Among these, as the surface treatment method, the method of adhering the siloxane compound to the surface of the silica particle by using supercritical carbon dioxide is preferable.

When performing the surface treatment in supercritical carbon dioxide, the siloxane compound is in a dissolved state in supercritical carbon dioxide. Since supercritical carbon dioxide has a characteristic of low interfacial tension, it may be considered that the siloxane compound in a state of being dissolved in supercritical carbon dioxide is likely to disperse and reach a deep part of a hole portion of the surface of the silica particle together with supercritical carbon dioxide, and the surface treatment is performed with the siloxane compound not only with respect to the surface of the silica particle, but also with respect to the deep part of the hole portion.

Therefore, the silica particle in which the surface treatment is performed with the siloxane compound in supercritical carbon dioxide is considered as a silica particle which is treated to be in a state where the surface is approximately uniform (for example, a state where the surface-treated layer is formed in a shape of a thin film) by the siloxane compound.

In addition, in the preparing method of the specific silica particle, the surface treatment of providing hydrophobicity to the surface of the silica particle by using the hydrophobizing agent together with the siloxane compound in supercritical carbon dioxide may be performed.

In this case, it is considered that both the siloxane compound and the hydrophobizing agent are dissolved in supercritical carbon dioxide, the siloxane compound and the hydrophobizing agent which are in a dissolved state in supercritical carbon dioxide are likely to disperse and reach the deep part of the hole portion of the surface of the silica particle together with supercritical carbon dioxide, and the surface treatment is performed with the siloxane compound and the hydrophobizing agent not only with respect to the surface of the silica particle, but also with respect to the deep part of the hole portion.

As a result, the silica particle which is surface-treated with the siloxane compound and the hydrophobizing agent in supercritical carbon dioxide, is treated with the siloxane compound and the hydrophobizing agent so that the surface becomes an approximately uniform state, and high hydrophobicity is likely to be given.

In addition, in the preparing method of the specific silica particle, in other preparing steps (for example, a solvent removing step) of the silica particle, supercritical carbon dioxide may be used.

Examples of the preparing method of the specific silica particle using supercritical carbon dioxide in other preparing steps include a preparing method of a silica particle, including: a step of preparing the silica particle dispersion containing silica particles and a solvent including alcohol and water, by the sol-gel method (hereinafter, referred to as "dispersion preparing step"); a step of removing the solvent from the silica particle dispersion by passing supercritical carbon dioxide (hereinafter, referred to as "solvent removing step"); and a step of treating the surface of the silica particle after removing the solvent with the siloxane compound, in supercritical carbon dioxide (hereinafter, referred to as "surface treatment step").

In addition, when removing the solvent from the silica particle dispersion by using supercritical carbon dioxide, formation of coarse powder is likely to be prevented.

The reason thereof is unknown, but the following reasons may be considered, such as 1) in a case of removing the solvent of the silica particle dispersion, it is possible to remove the solvent without aggregation between the particles by a liquid crosslinking force when removing the solvent, because of a characteristic of supercritical carbon dioxide that "the interfacial tension does not work", and 2) it is possible to remove the solvent in the silica particle dispersion without forming coarse powder such as secondary aggregates due to condensation of silanol groups, by coming into contact with supercritical carbon dioxide with high efficiency at a relatively low temperature (for example, 250° C. or lower) to dissolve the solvent, and by removing supercritical carbon dioxide in which the solvent is dissolved, because of a characteristic of supercritical carbon dioxide that "carbon dioxide is at a temperature and pressure which are equal to or higher than a critical point, and has both diffusibility of gas and solubility of liquid".

Here, the solvent removing step and the surface treatment step may be performed separately, but it is preferable to perform both steps consecutively (that is, each step is performed in a state of being closed to atmospheric pressure). When performing each step consecutively, after the solvent removing step, a chance for the silica particle to adsorb moisture is eliminated, and the surface treatment step is performed in a state where adsorption of excessive moisture to the silica particle is prevented. Accordingly, it is not necessary to perform the solvent removing step and the surface treatment step by using a large amount of siloxane compound or at a high temperature which causes excessive heating. As a result, formation of coarse powder is more effectively prevented.

Hereinafter, the preparing method of the specific silica particle will be described in detail for each step.

In addition, the preparing method of the specific silica particle is not limited thereto, and for example, may be 1) an aspect of using supercritical carbon dioxide only in the surface treatment step, and 2) an aspect of performing each step separately.

Hereinafter, each step will be described in detail.

Dispersion Preparing Step

In the dispersion preparing step, for example, silica particle dispersion containing the silica particle and the solvent including alcohol and water is prepared.

Specifically, in the dispersion preparing step, the silica particle dispersion is prepared by a wet type method (for example, the sol-gel method) and prepared. In particular, the silica particle dispersion may be prepared by the so-gel method which is the wet type method, specifically, by preparing the silica particles by causing the tetraalkoxysilane to react (hydrolysis reaction and condensation reaction) with the solvent, such as alcohol and water, in the presence of an alkaline catalyst.

In addition, a preferable range of the average equivalent circle diameter and a preferable range of the average circularity of the silica particles are the same as described above.

In the dispersion preparing step, for example, in a case where the silica particle is obtained by the wet type method, the silica particle is obtained in a state of the dispersion (silica particle dispersion) in which the silica particle is dispersed in the solvent.

Here, when the process moves on to the solvent removing step, a weight ratio of water to alcohol in the silica particle dispersion prepared may be, for example, from 0.05 to 1.0, and is preferably from 0.07 to 0.5, and more preferably from 0.1 to 0.3.

If the weight ratio of water to alcohol in the silica particle dispersion is set within the above range, coarse powder of the silica particles is formed less after the surface treatment, and silica particles having excellent electrical resistance are easily obtained.

If the weight ratio of water to alcohol is less than 0.05, in the solvent removing step, silanol groups on the surface of the silica particles are condensed less when the solvent is removed. Accordingly, the amount of moisture adsorbed onto the surface of the silica particles having undergone the solvent removal increases, so the electrical resistance of the silica particles is lowered too much after the surface treatment in some cases. Moreover, if the weight ratio of water exceeds 1.0, in the solvent removing step, a large amount of water remains at a point in time when the removal of the solvent in the silica particle dispersion is almost completed. Therefore, the silica particles easily aggregate with each other due to a liquid crosslinking force and become coarse powder after the surface treatment in some cases.

In addition, when the process moves on to the solvent removing step, a weight ratio of water to silica particle in the silica particle dispersion prepared may be, for example, from 0.02 to 3, and is preferably from 0.05 to 1, and more preferably from 0.1 to 0.5.

If the weight ratio of water to silica particle in the silica particle dispersion is set within the above range, coarse powder of the silica particles is formed less, and silica particles that have excellent electrical resistance are easily obtained.

If the weight ratio of water to silica particle is less than 0.02, in the solvent removing step, silanol groups on the surface of the silica particles are condensed extremely less when the solvent is removed. Accordingly, the amount of moisture adsorbed onto the surface of the silica particles having undergone the solvent removal increases, so the electrical resistance of the silica particles is lowered too much in some cases.

Moreover, if the weight ratio of water exceeds 3, in the solvent removing step, a large amount of water remains at a point in time when the removal of the solvent in the silica particle dispersion is almost completed. Therefore, the silica particles easily aggregate with each other due to a liquid crosslinking force.

In addition, when the process moves on to the solvent removing step, a weight ratio of silica particle to silica particle dispersion in the silica particle dispersion prepared may be, for example, from 0.05 to 0.7, and is preferably from 0.2 to 0.65, and more preferably from 0.3 to 0.6.

If the weight ratio of silica particle to silica particle dispersion is less than 0.05, in the solvent removing step, the amount of supercritical carbon dioxide used increases, and productivity deteriorates.

Moreover, if the weight ratio of silica particle to silica particle dispersion exceeds 0.7, a distance between the silica particles in the silica particle dispersion becomes closer, and coarse powder is easily formed due to aggregation or gelling of the silica particles.

Solvent Removing Step

The solvent removing step is, for example, a step of removing the solvent of the silica particle dispersion by passing supercritical carbon dioxide.

In other words, in the solvent removing step, supercritical carbon dioxide is brought into contact with the silica particle dispersion by making the supercritical carbon dioxide pass, so that the solvent is removed.

Specifically, in the solvent removing step, for example, the silica particle dispersion is put into a closed reactor. Thereafter, liquefied carbon dioxide is put into the closed reactor and heated, and the internal pressure of the reactor is increased using a high-pressure pump to place the carbon dioxide in a supercritical state. Subsequently, the supercritical carbon dioxide is guided in the closed reactor, discharged, and pass the inside of the closed reactor, that is, the silica particle dispersion.

In this manner, while dissolving the solvent (alcohol and water), the supercritical carbon dioxide is also discharged to the outside the silica particle dispersion (outside the closed reactor) with the solvent entrained, so that the solvent is removed.

Here, the supercritical carbon dioxide is carbon dioxide under a temperature and pressure that are equal to or higher than a critical point and has both the diffusibility of gas and the solubility of liquid.

A temperature condition for the solvent removal, that is, the temperature of the supercritical carbon dioxide may be, for example, from 31° C. to 350° C., and is preferably from 60° C. to 300° C., and more preferably from 80° C. to 250° C.

If the temperature is lower than the above range, the solvent is not easily dissolved in the supercritical carbon dioxide, and this makes it difficult to remove the solvent. In addition, it is considered that coarse powder may be easily formed due to a liquid crosslinking force of the solvent or the supercritical carbon dioxide. On the other hand, if the temperature exceeds the above range, it is considered that coarse powder such as secondary aggregates may be easily formed due to the condensation of silanol groups on the surface of the silica particles.

A pressure condition for the solvent removal, that is, the pressure of the supercritical carbon dioxide may be, for example, from 7.38 MPa to 40 MPa, and is preferably from 10 MPa to 35 MPa, and more preferably from 15 MPa to 25 MPa.

If the pressure is lower than the above range, the solvent tends not to be easily dissolved in the supercritical carbon dioxide. On the other hand, if the pressure exceeds the above range, the cost of facilities tends to increase.

The amount of the supercritical carbon dioxide injected into and discharged from the closed reactor may be, for example, from 15.4 L/min/$m^3$ to 1,540 L/min/$m^3$, and is preferably from 77 L/min/$m^3$ to 770 L/min/$m^3$.

If the injected and discharged amount is less than 15.4 L/min/$m^3$, productivity tends to easily deteriorate since it takes a time for removing the solvent.

On the other hand, if the injected and discharged amount exceeds 1,540 L/min/$m^3$, the time during which the supercritical carbon dioxide is in contact with the silica particle dispersion is shortened due to the short passage of the supercritical carbon dioxide. Accordingly, the solvent tends not to be easily removed efficiently.

Surface Treatment Step

The surface treatment step is, for example, a step of treating the surface of the silica particles with a siloxane compound in supercritical carbon dioxide, consecutively after the solvent removing step.

In other words, in the surface treatment step, for example, while the reactor is not open to the atmosphere before the process moves on from the solvent removing step, the surface of the silica particles is treated with a siloxane compound in the supercritical carbon dioxide.

Specifically, in the surface treatment step, for example, the supercritical carbon dioxide injected into and discharged from the closed reactor in the solvent removing step is stopped being injected and discharged, and then the internal temperature and pressure of the closed reactor are adjusted. In addition, in a state where the supercritical carbon dioxide is present in the closed reactor, a siloxane compound is put into the container in a certain proportion based on the silica particles. In addition, while this state is being maintained, that is, in the supercritical carbon dioxide, the siloxane compound is reacted, thereby treating the surface of the silica particles.

Here, in the surface treatment step, the siloxane compound needs to be reacted in the supercritical carbon dioxide (that is, under the atmosphere of the supercritical carbon dioxide), and the surface treatment may be performed while the supercritical carbon dioxide is being passed (that is, while the supercritical carbon dioxide is being injected into and discharged from the closed reactor), or may be performed without the passing of the supercritical carbon dioxide.

In the surface treatment step, the amount (that is, the charged amount) of the silica particles based on the volume of the reactor may be, for example, from 30 g/L to 600 g/L, and is preferably from 50 g/L to 500 g/L, and more preferably from 80 g/L to 400 g/L.

If the amount is smaller than the above range, a concentration of the siloxane compound based on the supercritical carbon dioxide decreases, and thus, the probability of the contact between the siloxane compound and the surface of silica decreases, which makes it difficult for the reaction to proceed. On the other hand, if the amount is larger than the above range, a concentration of the siloxane compound based on the supercritical carbon dioxide increases, and thus, the siloxane compound does not fully dissolve in the supercritical carbon dioxide and causes a dispersion defect, so that coarse aggregates are easily formed.

A density of the supercritical carbon dioxide may be, for example, from 0.10 g/ml to 0.80 g/ml, and is preferably from 0.10 g/ml to 0.60 g/ml, and more preferably from 0.2 g/ml to 0.50 g/ml.

If the density is lower than the above range, solubility of the siloxane compound in the supercritical carbon dioxide decreases, so that aggregates tend to be formed. On the other hand, if the density is higher than the above range, the diffusibility of the supercritical carbon dioxide into the pores of silica deteriorates, such that the surface treatment may be performed insufficiently. Particularly, for sol-gel silica particles containing a large amount of silanol groups, it is preferable to perform the surface treatment within the above density range.

The density of the supercritical carbon dioxide is adjusted by the temperature, pressure, and the like.

Specific examples of the siloxane compound are the same as described above. In addition, a preferable range of viscosity of the siloxane compound is also the same as described above.

Among the siloxane compounds, when silicone oil is employed, the silicone oil is likely to adhere to the surface of the silica particle in an approximately uniform state, and fluidity and aggregation properties of the silica particle are likely to be improved.

The amount of the siloxane compound used with respect to the silica particle, for example, may be from 0.05% by weight to 3% by weight, preferably from 0.1% by weight to 2% by weight, and more preferably from 0.15% by weight to 1.5% by weight, from the viewpoint that the surface attachment amount with respect to the silica particle is easily controlled to be from 0.01% by weight to 5% by weight.

In addition, the siloxane compound may be used alone, and may be used as liquid mixed with the solvent in which the silica particle is easily dissolved. Examples of the solvent include toluene, methyl ethyl ketone, and methyl isobutyl ketone.

In the surface treatment step, the surface treatment of the silica particle may be performed with a mixture containing a siloxane compound and a hydrophobizing agent.

An example of the hydrophobizing agent includes a silane hydrophobizing agent. An example of the silane hydrophobizing agent includes a known silicon compound containing an alkyl group (for example, a methyl group, an ethyl group, a propyl group, and a butyl group), and a specific example includes a silazane compound (for example, a silane compound, such as methyltrimethoxysilane, dimethyldimethoxysilane, trimethylchlorosilane, and trimethylmethoxysilane; hexamethyldisilazane; and tetramethyldisilazane). The hydrophobizing agent may be used alone or in combination of plural kinds thereof.

Among the silane hydrophobizing agents, the silicon compound containing a trimethyl group, such as trimethylmethoxysilane and hexamethyldisilazane (ENDS), particularly hexamethyldisilazane (HMDS), is preferable.

The amount of the silane hydrophobizing agent used is not particularly limited, and, for example, with respect to the silica particle, may be from 1% by weight to 100% by weight, preferably from 3% by weight to 80% by weight, and more preferably from 5% by weight to 50% by weight.

In addition, the silane hydrophobizing agent may be used alone, and may be used as liquid mixed with the solvent in which the silane hydrophobizing agent is easily dissolved. Examples of the solvent include toluene, methyl ethyl ketone, and methyl isobutyl ketone.

The temperature condition of the surface treatment, that is, the temperature of supercritical carbon dioxide is, for example, from 80° C. to 300° C., preferably from 100° C. to 250° C., and more preferably from 120° C. to 200° C.

When the temperature is less than above range, there is a case where performance of the surface treatment with the siloxane compound deteriorates. On the other hand, when the temperature exceeds the above range, there is a case where condensation reaction between silanol groups of the silica particle proceeds, and particle aggregation occurs. In particular, the surface treatment within the above temperature range may be performed with respect to the sol-gel silica particle containing a large amount of silanol groups.

Meanwhile, a pressure condition of the surface treatment, that is, pressure of supercritical carbon dioxide may be a condition which satisfies the above-described density, and, for example, may be from 8 MPa to 30 MPa, preferably from 10 MPa to 25 MPa, and more preferably from 15 MPa to 20 MPa.

The specific silica particle is obtained through each step described above.

Resin Particle Containing (Meth)Acrylic Acid Ester

The resin particle containing (meth)acrylic acid ester is a resin particle containing a polymer obtained by polymerizing the (meth)acrylic acid ester monomers. The (meth) acrylic acid is an expression including any of acrylic acid and methacrylic acid.

Specific examples of the polymer obtained by polymerizing the (meth)acrylic acid ester monomers include: a homopolymer of the (meth)acrylic acid ester monomer; a copolymer in which two or more types of (meth)acrylic acid ester monomers are combined; a copolymer in which the (meth)acrylic acid ester monomer and other types of monomers are combined; a graft polymer obtained by polymerizing vinyl monomers (including the (meth)acrylic acid ester monomer) in the coexistence of these components; and a mixture of these components.

Hereinafter, "polymer (homopolymer, copolymer, or graft polymer) obtained by polymerizing the (meth)acrylic acid ester monomers will be referred to as "specific (meth)acrylic acid ester polymer".

A ratio of the specific (meth)acrylic acid ester polymer included in the resin particle containing (meth)acrylic acid ester is, for example, 50% by weight or more, preferably 80% by weight or more, more preferably 90% by weight or more, and still more preferably 100% by weight.

Examples of the (meth)acrylic acid ester monomer include (meth)acrylic acid alkyl ester (for example, linear or branched alkyl ester of (meth)acrylic acid, such as methyl (meth)acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth) acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, neopentyl (meth)acrylate, isohexyl (meth)acrylate, isoheptyl (meth)acrylate, isooctyl (meth)acrylate, or 2-ethylhexy (meth)acrylate; or (meth) acrylic acid cycloalkyl ester, such as cyclobutyl (meth) acrylate, cyclopentyl (meth)acrylate, cyclohexyl (meth) acrylate, cycloheptyl (meth)acrylate, cyclooctyl (meth) acrylate, cyclodecyl (meth)acrylate, cyclododecyl (meth) acrylate, or t-butyl cyclohexyl (meth)acrylate), (meth) acrylic acid aryl ester (for example, phenyl (meth)acrylate, biphenyl (meth)acrylate, diphenylethyl (meth)acrylate, t-butylphenyl (meth)acrylate, or terphenyl (meth)acrylate), methoxyethyl (meth)acrylate, 2-hydroxyethyl (meth)acrylate, or β-carboxyethyl (meth)acrylate.

These (meth)acrylic acid ester monomers may be used alone, or in combination of two or more kinds thereof.

Among these, as the (meth)acrylic acid ester monomer, (meth)acrylic acid alkyl ester is preferable from the viewpoint of preventing the toner scatter of the charging member caused by the passing of the resin particle containing (meth) acrylic acid ester from the cleaning portion. The alkyl group of (meth)acrylic acid alkyl ester may be linear, branched, or cyclic, but the linear shape is preferable. In addition, the alkyl group also includes a substituted alkyl group substituted with an alkoxy group, a hydroxy group, a cyano group, or a halogen atom.

The number of carbon atoms of the alkyl group of the (meth)acrylic acid alkyl ester monomer is preferably from 1 to 12, more preferably from 1 to 10, still more preferably from 1 to 8, and particularly preferable from 1 to 5.

The specific (meth)acrylic acid ester polymer may have a crosslinking structure. Examples of the specific (meth) acrylic acid ester polymer having the crosslinking structure include a crosslinked product which is obtained by at least copolymerizing the (meth)acrylic acid ester monomer and a crosslinkable monomer.

A weight average molecular weight of the specific (meth) acrylic acid ester polymer is preferably, for example, from 5,000 to 150,000, more preferably from 8,000 to 120,000, and still more preferably from 10,000 to 100,000.

In addition, the weight average molecular weight is measured by a gel permeation chromatography (GPC). The measurement of the molecular weight by the GPC is performed by using a GPC•HLC-8120 GPC manufactured by Tosoh Corporation as a measurement apparatus, a Column•TSKgel SuperHM-M (15 cm) manufactured by Tosoh Corporation, and a THF solvent. The weight average molecular weight is calculated by using a molecular weight calibration curve which is drawn up by a monodisperse polystyrene standard sample from the measurement result.

In a case where the specific (meth)acrylic acid ester polymer is a copolymer obtained by combining the (meth) acrylic acid ester monomer and other monomers, other monomers to be used in polymerizing the copolymer are not particularly limited, but examples thereof include: (meth) acrylic acid; aromatic vinyl monomer; a crosslinkable monomer (for example, divinylbenzene or ethylene glycol dimethacrylate); nitrile monomer (for example, acrylonitrile); or unsaturated hydrocarbon monomer (for example, 1,3-butadiene). In addition, the aromatic vinyl monomer is an aromatic compound having one or more vinyl groups in a molecule.

In addition, in a case where the specific (meth)acrylic acid ester polymer is a copolymer obtained by combining the (meth)acrylic acid ester monomer and other monomers, a ratio of the (meth)acrylic acid ester monomer included in the specific (meth)acrylic acid ester polymer is, for example, 50% by weight or more, preferably 80% by weight or more, and more preferably 90% by weight or more.

Among the (meth)acrylic acid ester polymers, methyl (meth)acrylate and cyclohexyl (meth)acrylate are preferable from the viewpoint of preventing the toner scatter of the charging member caused by the passing of the resin particle containing (meth)acrylic acid ester from the cleaning portion.

The resin particle containing (meth)acrylic acid ester may be synthesized by various polymerizing method, such as solution polymerization, precipitation polymerization, suspension polymerization, bulk polymerization, and emulsion polymerization. In addition, polymerization reaction may be performed by a known operation, such as a batch type, a semi-continuous type, and a continuous type.

In addition, the resin particle containing (meth)acrylic acid ester and the specific (meth)acrylic acid ester polymer may be those which are obtained.

The average equivalent circle diameter of the resin particle containing (meth)acrylic acid ester is preferably from 200 nm to 2,000 nm, more preferably from 200 nm to 1,000 nm, and still more preferably from 200 nm to 800 nm from the viewpoint of preventing the toner scatter of the charging member caused by the passing of the resin particle containing (meth)acrylic acid ester from the cleaning portion.

The average equivalent circle diameter of the resin particle containing (meth)acrylic acid ester is a value measured by the following method.

An image is captured by observing a primary particle after externally adding the resin particle containing (meth)acrylic acid ester to the toner particle by a scanning electron microscope (SEM) device (manufactured by Hitachi, Ltd.: S-4100), the image is input to an image analyzing device (WinROOF manufactured by Mitani Corporation), an area is measured for each particle by analyzing the image of the primary particle, and an equivalent circle diameter is calculated from the area value. The diameter of 50% (D50) in cumulative frequency of the obtained equivalent circle diameter is the average equivalent circle diameter D50 of the resin particle containing (meth)acrylic acid ester. In addition, the electron microscope adjusts magnification so as to capture approximately 10 to 50 resin particles containing (meth)acrylic acid ester in one visual field, and the equivalent circle diameter of the primary particle is obtained by combining the observation results of the plural visual fields.

The particle diameter ratio (D(si)/D(r)) of an average equivalent circle diameter (D(si)) of the silica particles and an average equivalent circle diameter (D(r)) of the resin particles is preferably from 0.048 to 0.650, The external addition amount of the resin particle containing (meth)acrylic acid ester is, for example, preferably from 0.1% by weight to 2% by weight, and more preferably from 0.1% by weight to 1.5% by weight with respect to the entirety of the toner particles, from the viewpoint preventing the toner scatter of the charging member caused by the passing of the resin particle containing (meth)acrylic acid ester from the cleaning portion.

Other Additives

Examples of other additives include, for example an inorganic particle. Examples of the inorganic particle include $SiO_2$ (except the specific silica particle), $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O$—$(TiO_2)n$, $Al_2O_3.2SiO_2$, $CaCO_3$, $MgCO_3$, $BaSo_4$, or $MgSO_4$.

A surface of the inorganic particle which serves as other external additives may be hydrophobized. The hydrophobic treatment is performed, for example, by dipping the inorganic particle into a hydrophobizing agent. The hydrophobizing agent is not particularly limited, but examples thereof include a silane coupling agent, silicone oil, a titanate coupling agent, or an aluminate coupling agent. These hydrophobizing agents may be used alone or in combination of two or more kinds thereof.

In general, the amount of the hydrophobizing agent is, for example, from 1 part by weight to 10 parts by weight with respect to 100 parts by weight of the inorganic particle.

Examples of other external additives also include a resin particle (resin particles, such as polystyrene or a melamine resin, excluding the resin particle containing (meth)acrylic acid ester), or a cleaning aid (for example, particles of metal salt of a higher fatty acid which is represented by zinc stearate, and a fluorine high weight polymer).

An external addition amount of other external additives is, for example, preferably from 0% by weight to 5% by weight, and more preferably from 0% by weight to 4% by weigh, with respect to the toner particle.

Method of Preparing Toner

Next, the preparing method of the toner according to the exemplary embodiment will be described.

The toner according to the exemplary embodiment is obtained by externally adding the external additives to the toner particles after preparing the toner particles.

The toner particles may be prepared by any of a dry preparing method (for example, a kneading and pulverizing method) and a wet preparing method (for example, an aggregating and coalescing method, a suspending and polymerizing method, and a dissolving and suspending method). The preparing method of the toner particles is not particularly limited to these methods, and a known preparing method is employed.

Among these, the toner particle may be obtained by the aggregating and coalescing method.

Specifically, for example, in a case of preparing the toner particles by the aggregating and coalescing method, the toner particles are prepared via a step (resin particle dispersion preparing step) of preparing a resin particle dispersion in which the resin particles which become the binder resin are dispersed; a step (aggregated particle forming step) of forming aggregated particles by aggregating the resin particles (other particles as necessary) in the resin particle dispersion (in the dispersion after mixing other particle dispersions therein as necessary); and a step (coalescing step) of forming the toner particles by heating an aggregated particle dispersion in which the aggregated particles are dispersed, and by coalescing the aggregated particles.

Hereinafter, each step will be described in detail.

In the description below, a method of obtaining the toner particles which contain the coloring agent and the release agent will be described, but the coloring agent and the release agent are used as necessary. It goes without saying that additives other than the coloring agent and the release agent may be used.

Resin Particle Dispersion Preparing Step

First, the coloring agent particle dispersion in which coloring agent particles are dispersed and a release agent particle dispersion in which release agent particles are dispersed, are prepared together with the resin particle dispersion in which the resin particles which become the binder resin are dispersed.

Here, the resin particle dispersion is prepared, for example, by dispersing the resin particles in a dispersion medium by a surfactant.

Examples of the dispersion medium used for the resin particle dispersion include aqueous mediums.

Examples of the aqueous mediums include water such as distilled water and ion exchange water, and alcohol. These may be used alone or in combination of two or more kinds thereof.

Examples of the surfactant include anionic surfactants such as sulfate ester salt, sulfonate, phosphate, and soap anionic surfactants; cationic surfactants such as amine salt and quaternary ammonium salt cationic surfactants; and nonionic surfactants such as polyethylene glycol, alkylphenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

In the resin particle dispersion, examples of a dispersing method of the resin particles in the dispersion medium include a general dispersing method which uses a ball mill which has a rotation shearing type homogenizer or a media, a sand mill, or a dyno mill. In addition, the resin particles may be dispersed in the resin particle dispersion by using a phase inversion emulsification method according to the type of the resin particles.

In addition, the phase inversion emulsification method is a method of performing resin inversion (so-called phase inversion) from W/O to O/W to form a non-continuous phase, and dispersing the resin in the aqueous medium in a particle shape, by dissolving the resin to be dispersed into a hydrophobic organic solvent which may dissolve the resin, and by putting aqueous medium (W phase) therein after performing neutralization by adding a base into an organic continuous phase (O phase).

The volume average particle diameter of the resin particles which are dispersed in the resin particle dispersion is preferably from 0.01 μm to 1 μm, more preferably from 0.08 μm to 0.8 μm, and still more preferably from 0.1 μm to 0.6 μm, for example.

In addition, in the volume average particle diameter of the resin particles, the particle diameter distribution which is obtained by measurement using a laser diffraction type particle diameter distribution measurement apparatus (for example, LA-700 manufactured by Horiba, Ltd.), is used, the cumulative distribution regarding the volume from the small particle diameter side with respect to the divided particle diameter range (channel) is drawn, and the particle size which has cumulation of 50% with respect to the entirety of the particles is set as the volume average particle diameter D50v. The volume average particle diameters of the particles in other dispersions are measured in a similar manner.

The content of the resin particles which is included in the resin particle dispersion is preferably from 5% by weight to 50% by weight, and more preferably from 10% by weight to 40% by weight.

In the same manner as in the preparation of the resin particle dispersion, the coloring agent particle dispersion and the release agent particle dispersion are also prepared. In other words, details of the volume average particle diameter, the dispersion medium, and the dispersing method of the particles, and the content of the particles in the resin particle dispersion, are also applicable to those for the coloring agent particles dispersed in the coloring agent particle dispersion and the release agent particles dispersed in the release agent particle dispersion.

Aggregated Particle Forming Step

Next, the coloring agent particle dispersion and the release agent particle dispersion are mixed with resin particle dispersion.

In addition, the aggregated particles which have a diameter which is close to a diameter of the toner particles for heteroaggregating the resin particles, the coloring agent particles, and the release agent particles, and include the resin particles, the coloring agent particles, and the release agent particles, are formed in a mixed dispersion.

Specifically, for example, the aggregated particles are formed by adding an aggregating agent into the mixed dispersion, adjusting pH levels of the mixed dispersion to be acidic (for example, from pH 2 to pH 5), adding a dispersion stabilizer as necessary, and then, heating the resultant to the temperature close to the glass transition temperature of the resin particles (specifically, for example, from the glass transition temperature of the resin particles—30° C. to the glass transition temperature—10° C.), and aggregating the particles which are dispersed in the mixed dispersion.

In the aggregated particle forming step, for example, heating may be performed after adding the aggregating agent at a room temperature (for example, 25° C.) while stirring the mixed dispersion by the rotation shearing type homogenizer, adjusting pH levels of the mixed dispersion to be acidic (for example, from pH 2 to pH 5), and adding the dispersion stabilizer as necessary.

Examples of the aggregating agent include a surfactant having a polarity reversed to that of the surfactant which is used as a dispersing agent added to the mixed dispersion, inorganic metal salt, and a di- or higher-valent metal complex. In particular, in a case where the metal complex is used as the aggregating agent, the amount of the surfactant used is reduced, and charging characteristics are improved.

An additive which forms a complex of the aggregating agent and a metal ion or a similar bond may be used as necessary. As the additive, a chelating agent may be appropriately used.

Examples of the inorganic metal salt include a metal salt, such as, calcium chloride, calcium nitrate, barium chloride, magnesium chloride, zinc chloride, aluminum chloride, and aluminum sulfate, and an inorganic metal salt polymer, such as polyaluminum chloride, polyaluminium hydroxide, and calcium polysulfide.

As the chelating agent, an aqueous chelating agent may be used. Examples of the chelating agent include an oxycarboxylic acid, such as tartaric acid, citric acid, and gluconic acid, iminodiacetic acid (IDA), nitrilotriacetic acid (NTA), and ethylenediaminetetraacetic acid (EDTA).

An addition amount of the chelating agent is preferably from 0.01 parts by weight to 5.0 parts by weight, and more preferably 0.1 parts by weight and less than 3.0 parts by weight with respect to 100 parts by weight of the resin particles.

Coalescing Step

Next, the toner particles are formed by coalescing the aggregated particles by heating the aggregated particle dispersion in which the aggregated particles are dispersed, for example, at a glass transition temperature or higher (for example, equal to or greater than a temperature which is higher than the glass transition temperature of the resin particles by 10° C. to 30° C.) of the resin particles.

In the above-described step, the toner particles are obtained.

After obtaining the aggregated particle dispersion in which the aggregated particles are dispersed, the toner particles may be prepared via a step of forming second aggregated particles by further mixing the aggregated particle dispersion and the resin particle dispersion in which the resin particles are dispersed, and aggregating the mixture so that the resin particles further adhere to the surface of the aggregated particles, and a step of forming the toner particles having the core shell structure by heating the second aggregated particle dispersion in which the second aggregated particles are dispersed, and coalescing the second aggregated particles.

Here, after finishing the coalescing step, a known washing step, a solid-liquid separation step, and a drying step are performed on the toner particles which are formed in the solvent, and the toner particles which are in a dried state are obtained.

From the viewpoint of electrostatic properties, displacement washing by the ion exchange water may be sufficiently performed in the washing step. In addition, the solid-liquid separation step is not particularly limited, but from the viewpoint of productivity, suction filtration, pressure filtration, or the like, may be performed. In addition, the drying step is also not particularly limited, but from the viewpoint of productivity, freeze drying, flash drying, fluidized drying, vibration type fluidized drying, or the like, may be performed.

In addition, the toner according to the exemplary embodiment is prepared, for example, by adding and mixing the external additive into the obtained toner particles in a dried state. Mixing may be performed, for example, by a V BLENDER, a HENSCHEL MIXER, or a LODIGE MIXER. Furthermore, as necessary, by using a vibration classifier or a wind classifier, coarse particles of the toner may be removed.

Electrostatic Charge Image Developer

An electrostatic charge image developer according to exemplary embodiment includes at least the toner according to the exemplary embodiment.

The electrostatic charge image developer according to the exemplary embodiment may be a single-component developer including only the toner according to the exemplary embodiment, or may be a two-component developer obtained by mixing the toner and a carrier with each other.

The carrier is not particularly limited, and a known carrier is used. Examples of the carrier include: a coated carrier which is coated with the coating resin on a surface of a core which is made of magnetic particle; a magnetic particle dispersion type carrier in which the magnetic particles are dispersed and compounded in a matrix resin; or a resin impregnation type carrier in which porous magnetic particle a are impregnated with the resin.

In addition, the magnetic particle dispersion type carrier and the resin impregnation type carrier may be carriers in which the configuration particles of the carriers are cores, and the cores are coated with the coating resin.

Examples of the magnetic particle include a magnetic metal, such as iron, nickel, or cobalt, or a magnetic oxide, such as ferrite or magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinylketone, a vinyl chloride-vinyl acetate copolymer, a styrene-acrylic acid ester copolymer, a straight silicone resin having an organosiloxane bond or a modified article thereof, a fluorine resin, polyester, polycarbonate, a phenol resin, or an epoxy resin.

In addition, the coating resin and the matrix resin include other additives, such as a conductive particle.

Examples of the conductive particle include a metal, such as gold, silver, or copper, or a particle, such as carbon black, titanium oxide, zinc oxide, tin oxide, barium sulfate, aluminum borate, or potassium titanate.

Here, examples of the coating method of the surface of the core with the coating resin include a coating method by using a coated layer forming solution in which the coating resin and various additives, as necessary, are dissolved in an appropriate solvent. The solvent is not particularly limited, but may be selected by considering the coating resin to be used or suitability in coating.

Specific examples of the resin coating method include a dipping method of dipping the core in the coated layer forming solution, a spray method of spraying the coated layer forming solution onto the surface of the core, a fluid bed method of spraying the coated layer forming solution in a state where the core floats by fluid air, or a kneader-coater method of mixing the core of the carrier and the coated layer forming solution in the kneader-coater and removing the solvent.

In the two-component developer, a mixing ratio (weight ratio) of the toner and the carrier is preferably from toner: carrier=1:100 to 30:100, and more preferably from 3:100 to 20:100.

Image Forming Apparatus/Image Forming Method

An image forming apparatus and an image forming method according to the exemplary embodiment will be described.

The image forming apparatus according to the exemplary embodiment is provided with an image holding member; a charging unit that charges a surface of the image holding member; an electrostatic charge image forming unit that forms an electrostatic charge image on a charged surface of the image holding member; a developing unit that accommodates an electrostatic charge image developer, and develops the electrostatic charge image formed on the surface of the image holding member as a toner image by using the electrostatic charge image developer; a transfer unit that transfers the toner image formed on the surface of the image holding member onto a surface of a recording medium; a cleaning unit that has a cleaning blade for cleaning the surface of the image holding member; and a fixing unit that fixes the toner image transferred onto the surface of the recording medium. In addition, as the electrostatic charge image developer, the electrostatic charge image developer according to the exemplary embodiment is employed.

In the image forming apparatus according to the exemplary embodiment, an image forming method (the image forming method according to the exemplary embodiment) including: a charging step of charging a surface of an image holding member; an electrostatic charge image forming step of forming an electrostatic charge image on the charged surface of the image holding member; a developing step of developing the electrostatic charge image formed on the surface of the image holding member as a toner image by using the electrostatic charge image developer according to exemplary embodiment; a transfer step of transferring the toner image formed on the surface of the image holding member onto a surface of a recording medium; a cleaning step of cleaning the surface of the image holding member by the cleaning blade; and a fixing step of fixing the toner image transferred onto the surface of the recording medium, is performed.

As the image forming apparatus according to the exemplary embodiment, a known image forming apparatus is applied, such as a direct transfer-type apparatus which directly transfers the toner image formed on the surface of the image holding member and the recording medium; an intermediate transfer-type apparatus which primarily transfers the toner image formed on the surface of the image holding member onto a surface of an intermediate transfer member, and secondarily transfers the toner image transferred onto the surface of the intermediate transfer member onto the surface of the recording medium; an apparatus which includes an erasing unit which emits charge-erasing light to the surface of the image holding member after transferring the toner image before charging, and erases the charge.

In a case where the image forming apparatus according to the exemplary embodiment is an intermediate transfer-type apparatus, a transfer unit includes, for example, an intermediate transfer member having a surface onto which a toner image is transferred, a primary transfer unit that primarily transfers a toner image formed on the surface of the image holding member onto the surface of the intermediate transfer member, and a secondary transfer unit that secondarily transfers the toner image transferred onto the surface of the intermediate transfer member onto the surface of the recording medium.

In the image forming apparatus according to the exemplary embodiment, for example, a part including the developing unit may have a cartridge structure (process cartridge) which is detachable from the image forming apparatus. As the process cartridge, for example, a process cartridge which is provided with the developing unit that accommodates the electrostatic charge image developer according to the exemplary embodiment, is appropriately used.

Hereinafter, an example of the image forming apparatus according to the exemplary embodiment will be described, but the exemplary embodiment is not limited thereto. In the following description, main parts illustrated in the drawing will be described, and the description of other parts will be omitted.

FIG. 1 is a schematic configuration view illustrating the image forming apparatus according to the exemplary embodiment.

The image forming apparatus illustrated in FIG. 1 is provided with first to fourth electrophotographic type image forming units 10Y, 10M, 10C, and 10K (image forming units) which output images of each colors, such as yellow (Y), magenta (M), cyan (C), and black (K), based on color-separated image data. These image forming units (hereinafter, simply referred to as "unit" in some cases) 10Y, 10M, 10C, and 10K are aligned in parallel to be separated from each other by a preset distance in a horizontal direction. These units 10Y, 10M, 10C, and 10K may be process cartridges which are detachable from the image forming apparatus.

At an upper part of FIG. 1 of each unit 10Y, 10M, 10C, and 10K, an intermediate transfer belt 20 passes through each unit and extends as the intermediate transfer member. The intermediate transfer belt 20 is provided to be wound around a driving roll 22 and a supporting roll 24 which is in contact with an inner surface of the intermediate transfer belt 20, which are disposed to be separated from each other from left to right in the drawing, and travels in a direction toward the fourth unit 10K from the first unit 10Y. In addition, the supporting roll 24 is applied by a force in a direction of being apart from the driving roll 22 by a spring or the like, which is not illustrated, and a tension is given to the intermediate transfer belt 20 which is wound around both the driving roll 22 and the supporting roll 24. In addition, on a side surface of the image holding member of the intermediate transfer belt 20, an intermediate transfer member cleaning device 30 is provided facing the driving roll 22.

The toner including the toner of four colors, such as yellow, magenta, cyan, and black, accommodated in toner cartridges 8Y, 8M, 8C, and 8K is supplied to each of the developing devices (developing units) 4Y, 4M, 4C, and 4K of each of the units 10Y, 10M, 10C, and 10K.

Since the first to the fourth units 10Y, 10M, 10C, and 10K have similar configurations as each other, here, the first unit 10Y which is arranged on an upstream side of a traveling direction of an intermediate transfer belt and which forms a yellow image, will be described as a representative example. In addition, by providing reference numerals of magenta (M), cyan (C), and black (K) at a similar part to that of the first unit 10Y, instead of yellow (Y), the description of the second to the fourth units 10M, 10C, and 10K will be omitted.

The first unit 10Y has a photosensitive member 1Y which operates as the image holding member. In the periphery of the photosensitive member 1Y, a charging roll (an example of the charging unit) 2Y which charges a surface of the photosensitive member 1Y to a preset potential, an exposure device (an example of the electrostatic charge image forming unit) 3 which forms the electrostatic charge image by exposing the charged surface by using a laser beam 3Y based on a color-separated image signal, a developing device (an example of the developing unit) 4Y which supplies the charged toner to the electrostatic charge image and develops the electrostatic charge image, a primary transfer roll 5Y (an example of the primary transfer unit) which transfers the developed toner image onto the intermediate transfer belt 20, and a photosensitive member cleaning device (an example of the cleaning unit) 6Y which includes a cleaning blade 6Y-1 that removes the toner that remains on the surface of the photosensitive member 1Y after the primary transfer, are disposed in order.

The primary transfer roll 5Y is disposed on an inner side of the intermediate transfer belt 20, and is provided at a position which faces the photosensitive member 1Y. Each of bias supplies (not illustrated) which apply a primary transfer bias are connected to each of primary transfer rolls 5Y, 5M, 5C, and 5K. Each bias supply varies the transfer bias applied to each of the primary transfer rolls, by a control of a control portion which is not illustrated.

Hereinafter, an operation of forming the yellow image in the first unit 10Y will be described.

First, before the operation, a surface of the photosensitive member 1Y is charged to a potential having −600 V to −800 V by using the charging roll 2Y.

The photosensitive member 1Y is formed by layering a photosensitive layer on a substrate having conductivity (for example, a volume resistivity at 20° C.: $1\times10^{-6}$ Ωcm or less). The photosensitive layer generally has high resistance (resistance of a general resin), but when the photosensitive layer is irradiated with the laser beam 3Y, specific resistance of a part which is irradiated with the laser beam changes. Here, the laser beam 3Y is output to the surface of the charged photosensitive member 1Y via the exposure device 3, according to the image data for yellow which is sent from the control portion that is not illustrated. The photosensitive layer of the surface of the photosensitive member 1Y is irradiated with the laser beam 3Y, and accordingly, the electrostatic charge image having a yellow image pattern is formed on the surface of the photosensitive member 1Y.

The electrostatic charge image is an image which is formed on the surface of the photosensitive member 1Y by charging, and is a so-called negative latent image which is formed as the specific resistance of the irradiated part of the photosensitive layer deteriorates by the laser beam 3Y, and a charge which is charged on the surface of the photosensitive member 1Y flows, and meanwhile, the charge at a part which is not irradiated with the laser beam 3Y remains.

The electrostatic charge image formed on the photosensitive member 1Y is rotated up to a preset development position according to the travel of the photosensitive member 1Y. At this development position, the electrostatic charge image on the photosensitive member 1Y is visualized (developed) as the toner image, by a developing device 4Y.

In the developing device 4Y, for example, the electrostatic charge image developer which includes at least the yellow toner and the carrier is contained. The yellow toner is held on a developer roll (an example of a developer holding member) which performs frictional charging by agitating the inside of the developing device 4Y, and has a charge having the same polarity (negative polarity) as a band charge which is charged on the photosensitive member 1Y. As the surface of the photosensitive member 1Y passes through the developing device 4Y, the yellow toner electrostatically adheres to a latent image portion which is discharged on the surface of the photosensitive member 1Y, and the latent image is developed by the yellow toner. The photosensitive member 1Y in which the yellow toner image is formed travels at a continuous preset speed, and the toner image which is developed on the photosensitive member 1Y is transported to a preset primary transfer position.

When the yellow toner image on the photosensitive member 1Y is transported to the primary transfer position, a primary transfer bias is applied to the primary transfer roll 5Y, the electrostatic force toward the primary transfer roll 5Y from the photosensitive member 1Y acts on the toner image, and the toner image on the photosensitive member 1Y is transferred onto the intermediate transfer belt 20. The transfer bias which is applied at this time has a (+) polarity reverse to (−) polarity of the toner, and for example, is controlled to be +10 μA by the control portion (not illustrated) in the first unit 10Y.

Meanwhile, the toner which remains on the photosensitive member 1Y is removed and collected by the photosensitive member cleaning device 6Y.

A first transfer bias which is applied to the first transfer rolls 5M, 5C, and 5K after the second unit 10M is also controlled according to the first unit.

In this manner, the intermediate transfer belt 20 in which the yellow toner image is transferred by the first unit 10Y is transported in order through the second to the fourth units 10M, 10C, and 10K, and the toner images having each color are overlapped and multiply transferred.

The intermediate transfer belt 20 which passes through the first to the fourth units, and in which the toner images having four colors are multiply transferred, reaches a secondary transfer portion which is configured of the intermediate transfer belt 20, the supporting roll 24 which is in contact with the inner surface of the intermediate transfer belt, and a secondary transfer roll (an example of the secondary transfer unit) 26 which is disposed on an image holding surface side of the intermediate transfer belt 20. Meanwhile, a recording sheet (an example of the recording medium) P is supplied at a preset timing to a void with which the secondary transfer roll 26 and the intermediate transfer belt 20 come into contact, via a supply mechanism, and a secondary transfer bias is applied to the supporting roll 24. The transfer bias which is applied at this time has (−) polarity which is the same polarity as H) polarity of the toner, the electrostatic force toward a recording sheet P from the intermediate transfer belt 20 acts on the toner image, and the toner image on the intermediate transfer belt 20 is transferred onto the recording sheet P. In addition, the secondary transfer bias at this time is determined according to the resistance which is detected by a resistance detecting unit (not illustrated) that detects resistance of the secondary transfer portion, and is voltage-controlled.

After this, the recording sheet P is sent into a nip portion of a pair of fixing rolls in a fixing device (an example of the fixing unit) 28, the toner image is fixed onto the recording sheet P, and the fixing image is formed.

Examples of the recording sheet P which transfers the toner image include a plain paper sheet which is used in an electrophotographic type copying machine or a printer. In addition to the recording sheet P, examples of the recording medium also include an OHP sheet or the like.

In order to further improve the smoothness of the surface of the image after fixing is performed, it is preferable that the surface of the recording sheet P is smooth, and for example, a coated paper sheet which is prepared by coating a surface of the plain paper sheet with resin or the like, or an art paper sheet for printing, is appropriately used.

The recording sheet P on which the fixing of the color image is completed is discharged toward a discharge portion, and a series of the color image forming operations end.

Process Cartridge/Toner Cartridge

A process cartridge according to the exemplary embodiment will be described.

The process cartridge according to the exemplary embodiment includes the developing unit which accommodates the electrostatic charge image developer according to the exemplary embodiment, and develops the electrostatic charge image formed on the surface of the image holding member as the toner image by using the electrostatic charge image developer. The process cartridge is detachable from the image forming apparatus.

The process cartridge according to the exemplary embodiment is not limited to the above-described configuration, and may be configured to include the developing device, and at least one selected from other units, such as the image holding member, the charging unit, the electrostatic charge image forming unit, or the transfer unit, as necessary.

Here, an example of the process cartridge according to the exemplary embodiment will be described, but the exemplary embodiment is not limited thereto. In the following description, main parts illustrated in the drawing will be described, and the description of other parts will be omitted.

Figure 2:
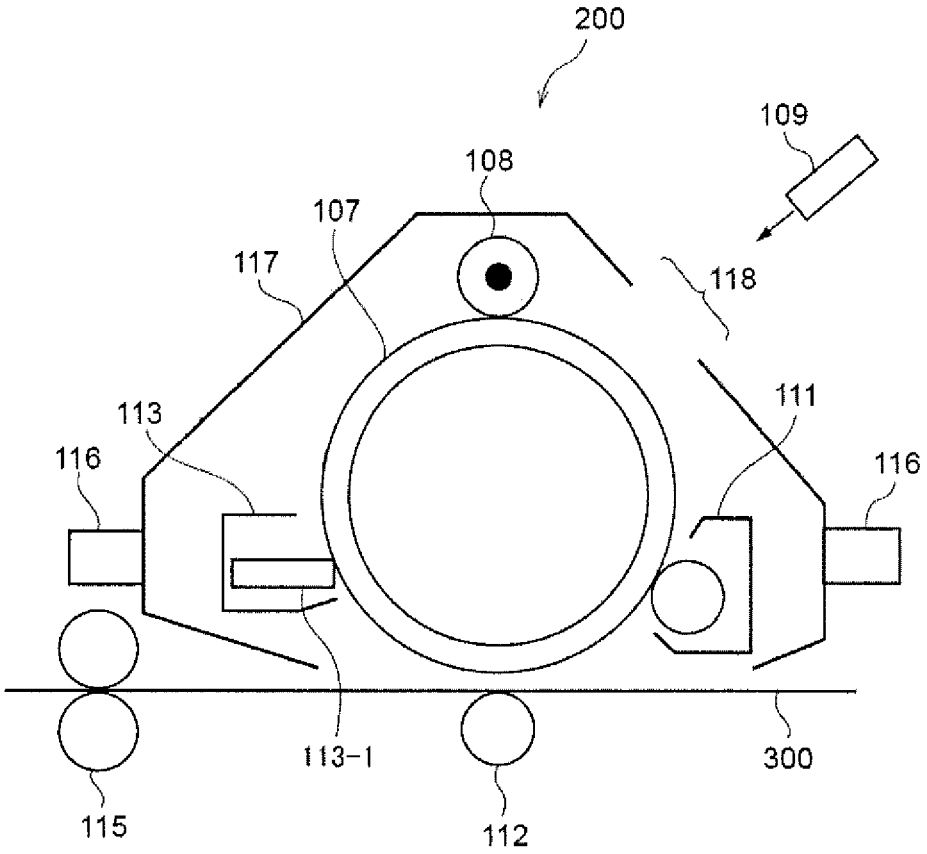
FIG. 2 is a schematic configuration view illustrating an example of a process cartridge according to the exemplary embodiment.

FIG. 2 is a schematic diagram showing a configuration of the process cartridge according to the exemplary embodiment.

A process cartridge 200 shown in FIG. 2 is formed as a cartridge having a configuration in which a photosensitive member 107 (an example of the image holding member), a charging roll 108 (an example of the charging unit), a developing device 111 (an example of the developing unit), and a photosensitive member cleaning device 113 (an example of the cleaning unit) including a cleaning blade 113-1, which are provided around the photosensitive member 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment contains the toner according to the exemplary embodiment and is detachable from an image forming apparatus. The toner cartridge accommodates a toner for replenishing the developing unit provided in the image forming apparatus by being supplied thereto. The toner cartridge according to the exemplary embodiment may have a container which contains the toner according to the exemplary embodiment.

The image forming apparatus shown in FIG. 1 is an image forming apparatus which has a configuration in which the toner cartridges 8Y, 8M, 8C, and 8K are detachable, and the developing devices 4Y, 4M, 4C, and 4K are connected to the toner cartridges corresponding to each developing device (color) by a toner supply pipe which is not shown. In addition, in a case where the amount of toner accommodated in the toner cartridge runs low, the toner cartridge is exchanged.

EXAMPLES

Hereinafter, the exemplary embodiment will be described in more detail by using examples, but the exemplary embodiment is not limited to the examples. In addition, in the following description, "parts" and "%" illustrate "parts by weight" and "% by weight" unless otherwise indicated.

Preparation of Toner Particle

Preparation of Toner Particle (1)

Preparation of Polyester Resin Particle Dispersion (1)

Ethylene glycol (manufactured by Wako Pure Chemical Industries, Ltd.): 37 parts

Neopentyl glycol (manufactured by Wako Pure Chemical Industries, Ltd.): 65 parts 1,9-Nonane diol (manufactured by Wako Pure Chemical Industries, Ltd.): 32 parts Terephthalic acid (manufactured by Wako Pure Chemical Industries, Ltd.): 96 parts The monomers are put in a flask, the temperature is increased to 200° C. over 1 hour, and after confirming that the inside of the reaction system is stirred, 1.2 parts of dibutyltin oxide is put therein. Furthermore, the temperature is increased to 240° C. over 6 hours from the above temperature while distilling the generated water, further, dehydrative condensation reaction is continued for 4 hours at 240° C., and thus, a polyester resin A in which an acid value is 9.4 mgKOH/g, a weight average molecular weight is 13,000, and a glass transition temperature is 62° C., is obtained, Next, while the polyester resin A is maintained in a melt state, the polyester resin A is transferred to CAVITRON CD1010 (manufactured by Eurotec Limited) at a speed of 100 parts per minute. 0.37% of rare ammonia aqueous solution prepared by diluting reagent ammonia aqueous solution by ion exchange water are put in an aqueous medium tank, and while performing the heating to 120° C. by a heat exchanger, is transferred to the CAVITRON at the speed of 0.1 liters per minute together with the molten polyester resin. Under the condition that the rotation speed of a rotor is 60 Hz and pressure is 5 Kg/cm$^2$, the CAVITRON is driven, and thus, a polyester resin dispersion (1) prepared by dispersing the resin particle in which the volume average particle diameter is 160 nm, the solid content is 30%, the glass transition temperature is 62° C., and the weight average molecular weight Mw is 13,000, is obtained.

Preparation of Coloring Agent Particle Dispersion

Cyan pigment (Pigment Blue 15:3 manufactured by Dainichiseika Color & Chemicals Mfg. Co., Ltd.): 10 parts Anionic surfactant (NEOGEN SC manufactured by Daiichi Kogyo Seiyaku Co., Ltd.): 2 parts Ion exchange water: 80 parts The coloring agent particle dispersion in which the volume average particle diameter is 180 nm and the solid content is 20% is obtained by mixing the above-described materials with each other, and dispersing the materials for 1 hour by using a high pressure impact type dispersing machine ultimizer (HJP30006 manufactured by Sugino Machine Limited).

Preparation of Release Agent Particle Dispersion

Carnauba wax (RC-160, melting temperature of 84° C., manufactured by Toakasei Co., Ltd.): 50 parts Anionic surfactant (NEOGEN SC manufactured by Daiichi Kogyo Seiyaku Co., Ltd.): 2 parts Ion exchange water: 200 parts The release agent particle dispersion in which the volume average particle diameter is 200 nm and the solid content is 20% is obtained by performing the dispersion treatment by using a pressure ejection type homogenizer after heating the above-described materials at 120° C., and mixing and dispersing the materials by using Ultra-turrax T50 manufactured by IKA.

Preparation of Toner Particle (1)

Polyester resin particle dispersion (1): 200 parts

Coloring agent particle dispersion: 25 parts

Release agent particle dispersion: 30 parts

Polyaluminum chloride: 0.4 parts

Ion exchange water: 100 parts

After putting the above-described materials into the flask made of stainless steel, and mixing and dispersing the materials by using ULTRA-TURRAX manufactured by IKA, heating is performed until the temperature of the flask reaches 48° C. while stirring the flask by a heating oil bus. After holding the materials at 48° C. for 30 minutes, 70 parts of the polyester resin particle dispersion (1) is added hereto.

After this, after adjusting pH in the system to 8.0 using 0.5 mol/L of sodium hydroxide aqueous solution, the flask made of stainless steel is tightly closed, a seal of the stirring axis is magnetically sealed, the heating is performed until the temperature of the flask reaches 90° C., and the flask is held for 3 hours. After finishing the reaction, cooling is performed at the temperature drop speed of 2° C./minute, filtering is performed, and washing is performed by the ion exchange water, and then, solid-liquid separation is performed by Nutsche type suction-filtering. This is further re-dispersed by using 3 L of ion exchange water at 30° C., and stirred and washed at 300 rpm for 15 minutes. While the washing operation is further repeated 6 times, and pH of the filtrate becomes 7.54, and electric conductivity becomes 6.5 μS/cm, the solid-liquid separation is performed by using No. 5A filter paper by the Nutsche type suction-filtering. Then, vacuum drying is continued for 12 hrs and thus, toner particle (1) are obtained. The volume average particle diameter of the toner particle (1) is 5.8 μm, and the average circularity is 0.96.

Preparation of Toner Particle (2)

Styrene-butyl acrylate copolymer (copolymerization ratio (weight ratio)=80:20, weight average molecular weight Mw=130,000, glass transition temperature Tg=59° C.): 88 parts Cyan pigment (C.I. Pigment Blue 15:3): 6 parts low molecular weight polypropylene (softening temperature: 148° C.): 6 parts The above-described materials are mixed with each other by the HENSCHEL MIXER, and are heated and kneaded by an extruder. After cooling the materials, the toner particle (2) in which the volume average particle diameter is 6.5 μm and the average circularity is 0.96 is obtained by coarsely/finely pulverizing the kneaded mixture and by further classifying the pulverized material.

Preparation of External Additive

Preparation of Silica Particle Dispersion (1)

300 parts of methanol and 70 parts of 10% ammonia aqueous solution are added and mixed in a glass reactor which has a volume of 1.5 L and is equipped with a stirrer, a dripping nozzle, and a thermometer, and thus, an alkali catalyst solution is obtained.

After adjusting the alkali catalyst solution to have 30° C., while being stirred, 185 parts of tetramethoxysilane and 50 parts of 8.0% ammonia aqueous solution are dripped at the same time, and thus, a hydrophilic silica particle dispersion (having a solid component concentration of 12.0% by weight) is obtained. Here, the dripping time is 30 minutes.

After this, the obtained silica particle dispersion is concentrated to 40% by weight of solid component concentration by a rotary filter R-Fine (manufactured by Kotobuki Industries Co., Ltd.). The concentrated dispersion is denoted as a silica particle dispersion (1).

Preparation of Silica Particle Dispersions (2) to (8)

Silica particle dispersions (2) to (8) are prepared in the same manner as in the preparation of the silica particle dispersion (1), except that the alkali catalyst solution (the amount of methanol, and the amount of 10% ammonia aqueous solution), and a formation condition of the silica particle (a total dripping amount of tetramethoxysilane (described as TMOS) and 8% of ammonia aqueous solution to the alkali catalyst solution, and dripping time) are changed as shown in Table 1 in preparing the silica particle dispersion (1).

Hereinafter, in Table 1, the silica particle dispersions (1) to (8) are collectively illustrated in detail.

TABLE 1

| | Alkali catalyst solution | | Formation condition of silica particle | | |
|---|---|---|---|---|---|
| Silica particle dispersion | Methanol (parts) | 10% ammonia aqueous solution (parts) | Total dripping amount of TMOS (parts) | Total dripping amount of 8% ammonia aqueous solution (parts) | Dripping time |
| (1) | 300 | 70 | 185 | 50 | 30 minutes |
| (2) | 300 | 70 | 340 | 92 | 55 minutes |
| (3) | 300 | 46 | 40 | 25 | 30 minutes |
| (4) | 300 | 70 | 62 | 17 | 10 minutes |
| (5) | 300 | 70 | 700 | 200 | 120 minutes |
| (6) | 300 | 70 | 500 | 140 | 85 minutes |
| (7) | 300 | 70 | 1000 | 280 | 170 minutes |
| (8) | 300 | 70 | 3000 | 800 | 520 minutes |

Preparation of Surface-treated Silica Particle (S1)

By using the silica particle dispersion (1), as described below, the surface treatment is performed with the siloxane compound under an atmosphere of supercritical carbon dioxide with respect to the silica particle. In addition, in the surface treatment, a device which is equipped with a carbon dioxide cylinder, a carbon dioxide pump, an entrainer pump, an autoclave with a stirrer (having a volume of 500 ml), and a pressure valve, is used.

First, 250 parts of the silica particle dispersion (1) is put into the autoclave with a stirrer (having a volume of 500 ml), and the stirrer is rotated at 100 rpm. After this, liquefied carbon dioxide is injected into the autoclave, the pressure is increased by the carbon dioxide pump while increasing the temperature by a heater, and the inside of the autoclave is placed in a supercritical state of 150° C. and 15 MPa. The supercritical carbon dioxide is passed by the carbon dioxide pump while maintaining the pressure inside the autoclave to be 15 MPa by the pressure valve, methanol and water are removed from the silica particle dispersion (1) (solvent removing step), and thus, the silica particle (untreated silica particle) is obtained.

Next, at a point when a passage amount of the supercritical carbon dioxide passed (integration amount: measured as a passage amount of carbon dioxide in a reference state) becomes 900 parts, the supercritical carbon dioxide is stopped to pass.

After this, in a state where temperature of 150° C. is maintained by the heater and pressure of 15 MPa is maintained by the carbon dioxide pump, and the supercritical state of carbon dioxide is maintained inside the autoclave, a treating agent solution in which 0.3 parts of dimethylsilicone oil (DSO: product name "KF-96 (manufactured by Shin-Etsu. Chemical Co, Ltd.)") having viscosity of 10,000 cSt as the siloxane compound is dissolved, is injected into the autoclave by the entrainer pump, to 20 parts of hexamethyldisilazane (HMDS: manufactured by Yuki Gosei Kogyo Co., Ltd.) as a hydrophobizing agent in advance, with respect to 100 parts of the above-described silica particles (untreated silica particles). Then, while being stirred, the solution is reacted for 20 minutes at 180° C. After this, the supercritical carbon dioxide passes again, and excessive treating agent solution is removed. After this, the stirring is stopped, the pressure inside the autoclave is released to the atmospheric pressure by opening the pressure valve, and the temperature is lowered to a room temperature (25° C.).

In this manner, by sequentially performing the solvent removing step and the surface treatment with the siloxane compound, a surface-treated silica particle (S1) is obtained.

Preparation of Surface-treated Silica Particles (S2) to (S5), (S7) to (S9), and (S12) to (S17)

Surface-treated silica particles (S2) to (S5), (S7) to (S9), and (S12) to (S17) are prepared similarly to the surface-treated silica particle (S1), except that the silica particle dispersion and the condition of the surface treatment (atmosphere of treatment, siloxane compound (a type, viscosity, and the amount added), the hydrophobizing agent, and the amount of the hydrophobizing agent added) are changed as shown in following Table 2 in preparing the surface-treated silica particle (S1).

Preparation of Surface-Treated Silica Particles (S6)

As described below, the surface treatment is performed with the siloxane compound under the atmosphere pressure with respect to the silica particles, by using the same dispersion as the silica particle dispersion (1) which is used in preparing the surface-treated silica particle (S1).

An ester adapter and a cooling tube are attached to the reactor which is used in preparing the silica particle dispersion (1), water is added when the silica particle dispersion (1) is heated to 60° C. to 70° C. and methanol is removed by distillation, and further, the temperature is heated to 70° C. to 90° C. and the methanol is removed by distillation, and an aqueous dispersion of the silica particle is obtained. 3 parts of methyltrimethoxysilane (MTMS: manufactured by Shin-Etsu Chemical Co, Ltd.) is added to 100 parts of silica solid contents in the aqueous dispersion at a room temperature, and is reacted for two hours, and the surface treatment of the silica particle is performed. After adding methyl isobutyl ketone to the surface treatment dispersion, the temperature is heated to 80° C. to 110° C., methanol water is removed by distillation, 80 parts of hexamethyldisilazane (HMDS: manufactured by Yuki Gosei Kogyo Co., Ltd.) and 1.0 parts of dimethylsilicone oil (DSO: product name "KF-96 (manufactured by Shin-Etsu Chemical Co, Ltd.)") having viscosity of 10,000 cSt as the siloxane compound are added to 100 parts of the silica solid contents in the obtained dispersion at a room temperature, the dispersion is reacted for 3 hours at 120° C. and is cooled. After this, the dispersion is dried by spraying and drying, and a surface-treated silica particle (S6) is obtained.

Preparation of Surface-Treated Silica Particle (S10)

A surface-treated silica particle (S10) is prepared according to a preparing method of the surface-treated silica particle (S1) except that fumed silica OX50 (AEROSIL OX50 manufactured by Nippon Aerosil Co., Ltd.) is used instead of the silica particle dispersion (1). In other words, 100 parts of the OX50 is put into the autoclave with the stirrer which is the same as that in preparing the surface-treated silica particle (S1), and the stirrer is rotated at 100 rpm. After this, the liquefied carbon dioxide is injected into the autoclave, the pressure is increased by the carbon dioxide pump while increasing the temperature by the heater, and the inside of the autoclave is placed in a supercritical state of 180° C. and 15 MPa. While maintaining the inside of the autoclave to be 15 MPa by the pressure valve, a treating agent solution in which 0.3 parts of dimethylsilicone oil (DSO: product name "KF-96 (manufactured by Shin-Etsu Chemical Co, Ltd.)") having viscosity of 10,000 cSt as the siloxane compound is dissolved in 20 parts of hexamethyldisilazane (HMDS: manufactured by Yuki Gosei Kogyo Co., Ltd.) as the hydrophobizing agent in advance, is injected into the autoclave by the entrainer pump. Then, while being stirred, the dispersion is reacted for 20 minutes at 180° C. After this, supercritical carbon dioxide is passed, excessive treating agent solution is removed, and the surface-treated silica particle (S10) is obtained.

Preparation of Surface-Treated Silica Particle (S11)

Surface-treated silica particle (S11) is prepared according to the preparing method of the surface-treated silica particle (S1) except that the amount of HMDS and the amount of DSO are changed by using a fumed silica A50 (AEROSIL A50 manufactured by Nippon Aerosil Co., Ltd.) instead of the silica particle dispersion (1). In other words, 100 parts of the A50 is put into the autoclave with the stirrer which is the same as that in preparing the surface-treated silica particle (S1), and the stirrer is rotated at 100 rpm. After this, the liquefied carbon dioxide is injected into the autoclave, the pressure is increased by the carbon dioxide pump while increasing the temperature by the heater, and the inside of the autoclave is placed in a supercritical state of 180° C. and 15 MPa. While maintaining the inside of the autoclave to be 15 MPa by the pressure valve, a treating agent solution in which 1.0 parts of dimethylsilicone oil (DSO: product name "KF-96 (manufactured by Shin-Etsu Chemical Co, Ltd.)") having viscosity of 10,000 cSt as the siloxane compound is dissolved in 40 parts of hexamethyldisilazane (HMDS: manufactured by Yuki Gosei Kogyo Co., Ltd.) as the hydrophobizing agent in advance, is injected into the autoclave by the entrainer pump. Then, while being stirred, the dispersion is reacted for 20 minutes at 180° C. After this, supercritical carbon dioxide is passed, excessive treating agent solution is removed, and the surface-treated silica particle (S11) is obtained.

Preparation of Surface-Treated Silica Particle (SC1)

A surface-treated silica particle (SC1) is prepared in the same manner as in the preparation of the surface-treated silica particle (S1) except that the siloxane compound is not added in preparing the surface-treated silica particle (S1).

Preparation of Surface-Treated Silica Particles (SC2) to (SC4)

Surface-treated silica particles (SC2) to (SC4) are prepared in the same manner as in the preparation of the surface-treated silica particle (S1) except that the silica particle dispersion and the condition of the surface treatment (atmosphere of treatment, siloxane compound (a type, viscosity, and the amount added), the hydrophobizing agent, and the amount added of the hydrophobizing agent) are changed as shown in Table 3, in preparing the surface-treated silica particle (S1).

Preparation of Surface-Treated Silica Particle (SC5)

A surface-treated silica particle (SC5) is prepared in the same manner as in the preparation of the surface-treated silica particle (S6) except that the siloxane compound is not added in preparing the surface-treated silica particle (S6).

Preparation of Surface-Treated Silica Particle (SC6)

After filtering the silica particle dispersion (8), and performing the drying at 120° C., the dispersion is put to the electric furnace, and is fired at 400° C. for 6 hours, and then, 10 parts of HMDS with respect to 100 parts of silica particle are sprayed and dried by a spray drier, and the surface-treated silica particle (SC6) is prepared.

Characteristics of Surface-Treated Silica Particle

With respect to the obtained surface-treated silica particles, an average equivalent circle diameter, average circularity, an adhesion amount (written as "surface attachment amount" in the table) of the siloxane compound with respect to the untreated silica particle, a compression aggregation degree, a particle compression ratio, and a particle dispersion degree, are measured by the above-described method.

Hereinafter, in Tables 2 and 3, the details of the surface-treated silica particle are illustrated. In addition, abbreviations in Tables 2 and 3 are as follows.

DSO: dimethylsilicone oil
HMDS: hexamethyldisilazane

TABLE 2

| Surface-treated silica particle | Silica particle dispersion | Condition of surface treatment: Siloxane compound: Type | Vis-cosity (cSt) | Amount added (parts) | Treatment atmosphere | Hydrophobizing agent/number of parts | Characteristics of surface-treated silica particle: Average equivalent circle diameter (nm) | Average circularity | Surface attachment amount (% by weight) | Compression aggregation degree (%) | Particle compression ratio | Particle dispersion degree (%) |
|---|---|---|---|---|---|---|---|---|---|---|---|---|
| (S1) | (1) | DSO | 10000 | 0.3 parts | super-critical $CO_2$ | HMDS/20 parts | 120 | 0.958 | 0.28 | 85 | 0.310 | 98 |
| (S2) | (1) | DSO | 10000 | 1.0 parts | super-critical $CO_2$ | HMDS/20 parts | 120 | 0.958 | 0.98 | 92 | 0.280 | 97 |
| (S3) | (1) | DSO | 5000 | 0.15 parts | super-critical $CO_2$ | HMDS/20 parts | 120 | 0.958 | 0.12 | 80 | 0.320 | 99 |
| (S4) | (1) | DSO | 5000 | 0.5 parts | super-critical $CO_2$ | HMDS/20 parts | 120 | 0.958 | 0.47 | 88 | 0.295 | 98 |
| (S5) | (2) | DSO | 10000 | 0.2 parts | super-critical $CO_2$ | HMDS/20 parts | 140 | 0.962 | 0.19 | 81 | 0.360 | 99 |
| (S6) | (1) | DSO | 10000 | 1.0 parts | Atmosphere | HMDS/80 parts | 120 | 0.958 | 0.50 | 83 | 0.380 | 93 |
| (S7) | (3) | DSO | 10000 | 0.3 parts | super-critical $CO_2$ | HMDS/20 parts | 130 | 0.850 | 0.29 | 68 | 0.350 | 92 |
| (S8) | (4) | DSO | 10000 | 0.3 parts | super-critical $CO_2$ | HMDS/20 parts | 90 | 0.935 | 0.29 | 94 | 0.390 | 95 |
| (S9) | (1) | DSO | 50000 | 1.5 parts | super-critical $CO_2$ | HMDS/20 parts | 120 | 0.958 | 1.25 | 95 | 0.240 | 91 |
| (S10) | Fumed silica OX50 | DSO | 10000 | 0.3 parts | super-critical $CO_2$ | HMDS/20 parts | 80 | 0.680 | 0.26 | 84 | 0.395 | 92 |
| (S11) | Fumed silica A50 | DSO | 10000 | 1.0 parts | super-critical $CO_2$ | HMDS/40 parts | 45 | 0.880 | 0.91 | 88 | 0.276 | 91 |
| (S12) | (3) | DSO | 5000 | 0.04 parts | super-critical $CO_2$ | HMDS/20 parts | 130 | 0.850 | 0.02 | 62 | 0.360 | 96 |
| (S13) | (3) | DSO | 1000 | 0.5 parts | super-critical $CO_2$ | HMDS/20 parts | 130 | 0.850 | 0.46 | 90 | 0.380 | 92 |
| (S14) | (3) | DSO | 10000 | 5.0 parts | super-critical $CO_2$ | HMDS/20 parts | 130 | 0.850 | 4.70 | 95 | 0.360 | 91 |
| (S15) | (5) | DSO | 10000 | 0.5 parts | super-critical $CO_2$ | HMDS/20 parts | 185 | 0.971 | 0.43 | 61 | 0.209 | 96 |
| (S16) | (6) | DSO | 10000 | 0.5 parts | super-critical $CO_2$ | HMDS/20 parts | 164 | 0.970 | 0.41 | 64 | 0.224 | 97 |
| (S17) | (7) | DSO | 10000 | 0.5 parts | super-critical $CO_2$ | HMDS/20 parts | 210 | 0.978 | 0.44 | 60 | 0.205 | 98 |

TABLE 3

| Surface-treated silica particle | Silica particle dispersion | Condition of surface treatment: Siloxane compound: Type | Vis-cosity (cSt) | Amount added (parts) | Treatment atmosphere | Hydrophobizing agent/number of parts | Characteristics of surface-treated silica particle: Average equivalent circle diameter (nm) | Average circularity | Surface attachment amount (% by weight) | Compression aggregation degree (%) | Particle compression ratio | Particle dispersion degree (%) |
|---|---|---|---|---|---|---|---|---|---|---|---|---|
| (SC1) | (1) | — | — | — | super-critical $CO_2$ | HMDS/20 parts | 120 | 0.958 | — | 55 | 0.415 | 99 |
| (SC2) | (1) | DSO | 100 | 3.0 parts | super-critical $CO_2$ | HMDS/20 parts | 120 | 0.958 | 2.5 | 98 | 0.450 | 75 |
| (SC3) | (1) | DSO | 1000 | 8.0 parts | super-critical $CO_2$ | HMDS/20 parts | 120 | 0.958 | 7.0 | 99 | 0.360 | 83 |
| (SC4) | (3) | DSO | 3000 | 10.0 parts | super-critical $CO_2$ | HMDS/20 parts | 130 | 0.850 | 8.5 | 99 | 0.380 | 85 |
| (SC5) | (1) | — | — | — | Atmosphere | HMDS/80 parts | 120 | 0.958 | — | 62 | 0.425 | 98 |
| (SC6) | (8) | — | — | — | Atmosphere | HMDS/10 parts | 300 | 0.980 | — | 60 | 0.197 | 93 |

Preparation of Polymethyl Methacrylate Particle (R1)

By mixing 100 parts of methyl methacrylate as a monomer, 1 part of ammonium persulfate as a polymerization initiator, 0.5 parts of sodium dodecylbenzenesulfonate as a suspension agent, and 200 parts of ion exchange water with each other, the monomer dispersion solution is obtained. By stirring the monomer dispersion solution at 70° C. for 7 hours, suspension in which the polymethyl methacrylate particle is dispersed in the water, is obtained. By drying the suspension, the polymethyl methacrylate particle (R1) is obtained as the polymethyl methacrylate particle.

Preparation of Polymethyl Methacrylate Particles (R2) to (R4), and (R6)

The polymethyl methacrylate particles (R2) to (R4), and (R6) are obtained in the same manner as in the preparation of the polymethyl methacrylate particle (R1) except that the amount of ion exchange water is changed in preparing the polymethyl methacrylate particle (R1).

Preparation of Polycyclohexyl Methacrylate Particle (R5)

The polycyclohexyl methacrylate particle (R5) is obtained in the same manner as in the preparation of the polymethyl methacrylate particle (R1) except the cyclohexyl methacrylate is used as the monomer in preparing the polymethyl methacrylate particle (R1).

Properties of Polyester Methacrylate Resin Particle

The average equivalent circle diameter of the obtained polyester methacrylate resin particle is measured by a known method.

Hereinafter, in Table 4, details of the polyester methacrylate particles (R1) to (R6) are illustrated.

TABLE 4

| Type of polyester methacrylate resin particle | Average equivalent circle diameter (nm) |
|---|---|
| Polymethyl methacrylate particle (R1) | 400 |
| Polymethyl methacrylate particle (R2) | 1800 |
| Polymethyl methacrylate particle (R3) | 2500 |
| Polymethyl methacrylate particle (R4) | 200 |
| Polycyclohexyl methacrylate particle (R5) | 450 |
| Polymethyl methacrylate particle (R6) | 160 |

Examples 1 to 19 and Comparative Examples 1 to 8

With respect to each combination of the toner particle, the silica particle, and the polyester methacrylate particle, which are illustrated in Table 5, 2 parts of silica particle and 0.5 parts of polyester methacrylate particle are added to 100 parts of toner particle, and are mixed for 3 minutes at 2,000 rpm by the HENSCHEL MIXER, and thus, the toner of each Example is obtained.

In addition, each of the obtained toner and carrier is put into the V BLENDER at a ratio of toner:carrier=5:95 (weight ratio), and is stirred for 20 minutes, and thus, each developer is obtained.

In addition, the carrier prepared as follows is used.

Ferrite particle (volume average particle diameter: 50 μm): 100 parts

Toluene: 14 parts

Styrene-methyl methacrylate copolymer: 2 parts (Component ratio: 90/10, Mw=80,000)

Carbon black (R330: manufactured by Cabot Corporation): 0.2 parts

First, by stirring the above-described components except the ferrite particle using a stirrer for 10 minutes, a dispersed coating liquid is prepared, and then, the coating liquid and the ferrite particle are put into the vacuum deaeration type kneader, and are stirred for 30 minutes at 60° C. After this, pressure is reduced while the temperature is increased to perform deaerating and drying and thus, the carrier is obtained.

Evaluation

The developing device of the image forming apparatus "DocuCentre-III C7600 manufactured by Fuji Xerox Co., Ltd." is filled with the developer obtained in each example. The following evaluation is performed by using the image forming apparatus. In addition, in the following evaluation, the charging roll is used as a charging member.

Evaluation of Color Streak

After the 5,000-th output of the belt-shaped image (10 mm×410 mm in the perpendicular direction with respect to the process direction, the same applies hereinafter) onto a paper sheet having an A3 size, one solid image is output onto the paper sheet having an A3 size.

With respect to the output solid image, it is visually confirmed whether or not the color streak caused by the toner scatter (hereinafter, also referred to as BCR toner scatter) of the charging roll is caused (evaluation over time 1-1).

Next, further, after the 3,000-th output of the belt-shaped image onto the paper sheet having an A3 size, one solid image is output onto the paper sheet having an A3 size. After this, by the same method as in the evaluation over time 1-1, it is visually confirmed whether or not the color streak caused by the BCR toner scatter is formed in the output solid image (evaluation over time 1-2).

Next, further, after the 2,000-th output of the belt-shaped image onto the paper sheet having an A3 size, one solid image is output onto the paper sheet having an A3 size. After this, by the same method as in the evaluation over time 1-1, it is visually confirmed whether or not the color streak caused by the BCR toner scatter is formed in the output solid image (evaluation over time 1-3).

In addition, the BCR toner scatter is caused by the passing of the polyester methacrylate resin particle which is an external additive of the toner particle, from the cleaning portion. Therefore, formation of the color streak in the evaluation indicates that a passing streak caused by the passing of the polyester methacrylate resin particle from the cleaning portion, that is, the BCR toner scatter, is formed.

The evaluation standard is as follows, and levels to G3 are allowable. The result is illustrated in Table 5.

Evaluation Standard of Color Streak

G1; Color streaks are not formed.

G2: Color streaks are minutely formed.

G3: Color streaks are slightly formed.

G4: Color streaks are present.

Wear Evaluation of Cleaning Blade

As follows, the wear evaluation of the cleaning blade is performed.

First, before the evaluation of the color streak, apart (hereinafter, referred to as an initial wear sectional area) at which the cleaning blade contacts with the photosensitive member is observed by a laser microscope, and the initial wear sectional area is measured.

Next, after the evaluation of the color streak, a part (hereinafter, referred to as a wear sectional area after the evaluation) at which the cleaning blade is in contact with the photosensitive member is observed by a laser microscope, and the wear sectional area after the evaluation is measured.

Next, the area obtained by subtracting the initial wear sectional area from the wear sectional area after the evaluation, the wear sectional area of the cleaning blade is obtained.

As follows, in the evaluation standard, levels to G2 are allowable. The result is illustrated in Table 5.

Evaluation Standard of Cleaning Blade

G1: Wear sectional area is less than 5 $\mu m^2$

G2: Wear sectional area is 5 $\mu m^2$ or more and less than 10 $\mu m^2$

G3: Wear sectional area is 10 $\mu m^2$ or more and less than 20 $\mu m^2$

G4: Wear sectional area is 20 $\mu m^2$ or more

TABLE 5

| | Toner particle | Surface-treated silica particle | Polyester methacrylate particle | Color streak Over time 1-1 | Over time 1-2 | Over time 1-3 | Wear of cleaning blade |
|---|---|---|---|---|---|---|---|
| Example 1 | 1 | S1 | R1 | G1 | G1 | G1 | G1 |
| Example 2 | 1 | S2 | R2 | G1 | G1 | G2 | G1 |
| Example 3 | 1 | S3 | R3 | G1 | G1 | G2 | G1 |
| Example 4 | 1 | S4 | R4 | G1 | G1 | G1 | G1 |
| Example 5 | 1 | S5 | R1 | G1 | G1 | G1 | G1 |
| Example 6 | 1 | S6 | R2 | G1 | G2 | G2 | G1 |
| Example 7 | 1 | S7 | R3 | G1 | G2 | G2 | G1 |
| Example 8 | 1 | S8 | R4 | G2 | G2 | G2 | G1 |
| Example 9 | 1 | S9 | R1 | G1 | G2 | G2 | G2 |
| Example 10 | 1 | S10 | R5 | G2 | G2 | G2 | G1 |
| Example 11 | 2 | S11 | R1 | G2 | G2 | G2 | G2 |
| Example 12 | 2 | S12 | R2 | G2 | G2 | G2 | G2 |
| Example 13 | 2 | S13 | R3 | G1 | G2 | G2 | G1 |
| Example 14 | 2 | S14 | R5 | G1 | G1 | G1 | G1 |
| Example 15 | 2 | S7 | R4 | G1 | G2 | G2 | G1 |
| Example 16 | 2 | S15 | R1 | G2 | G2 | G3 | G1 |
| Example 17 | 2 | S16 | R2 | G2 | G2 | G3 | G1 |
| Example 18 | 2 | S17 | R5 | G2 | G2 | G3 | G1 |
| Example 19 | 2 | S11 | R6 | G2 | G2 | G2 | G2 |
| Comparative example 1 | 1 | None | R1 | G4 | G4 | G4 | G1 |
| Comparative example 2 | 1 | SC1 | R1 | G4 | G4 | G4 | G1 |
| Comparative example 3 | 1 | SC2 | R1 | G2 | G3 | G4 | G3 |
| Comparative example 4 | 1 | SC3 | R1 | G4 | G4 | G4 | G4 |
| Comparative example 5 | 1 | SC4 | R1 | G2 | G3 | G4 | G3 |
| Comparative example 6 | 1 | SC5 | R3 | G4 | G4 | G4 | G1 |
| Comparative example 7 | 2 | SC1 | R1 | G4 | G4 | G4 | G1 |
| Comparative example 8 | 2 | SC6 | R6 | G3 | G3 | G4 | G1 |

From the above-described result, in the examples, compared to the comparative examples, it is ascertained that formation of the color streak caused by the BCR toner scatter is prevented. In other words, in the examples, compared to the comparative examples, it is ascertained that the BCR toner scatter caused by the passing of the polyester methacrylate particle from the cleaning portion, is prevented.

In particular, in Examples 1, 2, 3, 4, 5, and 14 in which the silica particle in which the compression aggregation degree is from 80% to 95% and the particle compression ratio is from 0.28 to 0.36, is employed as an external additive, compared to other examples, it is ascertained that formation of the color streak caused by the BCR toner scatter is prevented while preventing wear of the cleaning blade.

In addition, in Comparative Example 1 in which only the polyester methacrylate particle is employed as the external additive, it is confirmed that the color streak caused by the BCR toner scatter is formed while preventing wear of the cleaning blade.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a binder resin; and an external additive including silica particles having a compression aggregation degree is from 60% to 95% and a particle compression ratio is from 0.20 to 0.40, and resin particles containing a polymer obtained by polymerizing a (meth)acrylic acid ester monomer, wherein the silica particle is a silica particle which is surface-treated with a siloxane compound in which viscosity is from 1,000 cSt to 50,000 cSt, and in which a surface attachment amount of the siloxane compound is from 0.01% by weight to 5% by weight.

2. The electrostatic charge image developing toner according to claim 1, wherein an average equivalent circle diameter of the resin particles is from 200 nm to 2,000 nm.

3. The electrostatic charge image developing toner according to claim 1, wherein a particle diameter ratio (D(si)/D(r)) of an average equivalent circle diameter (D(si)) of the silica particles and an average equivalent circle diameter (D(r)) of the resin particles is from 0.048 to 0.650.

4. The electrostatic charge image developing toner according to claim 1, wherein the resin particle includes methyl (meth)acrylate and cyclohexyl (meth)acrylate.

5. The electrostatic charge image developing toner according to claim 1, wherein the average equivalent circle diameter of the silica particles is from 40 nm to 200 nm.

6. The electrostatic charge image developing toner according to claim 1, wherein a particle dispersion degree of the silica particles is from 90% to 100%.

7. The electrostatic charge image developing toner according to claim 1, wherein an average circularity of the silica particles is from 0.85 to 0.98.

8. The electrostatic charge image developing toner according to claim 1, wherein the silica particle is a sol-gel silica particle.

9. The electrostatic charge image developing toner according to claim 1, wherein an average circularity of the toner particles is from 0.94 to 1.00.

10. The electrostatic charge image developing toner according to claim 1, wherein the siloxane compound is silicone oil.

11. An electrostatic charge image developer comprising:

the electrostatic charge image developing toner according to claim 1.

12. A toner cartridge comprising:

a container that contains the electrostatic charge image developing toner according to claim 1, wherein the toner cartridge is detachable from an image forming apparatus.

* * * * *